US009195154B2

(12) United States Patent
Fujii

(10) Patent No.: US 9,195,154 B2
(45) Date of Patent: Nov. 24, 2015

(54) ELECTROPHOTOGRAPHIC PHOTORECEPTOR AND IMAGE FORMING APPARATUS

(71) Applicant: Mitsubishi Chemical Corporation, Chiyoda-ku (JP)

(72) Inventor: Akiteru Fujii, Kanagawa (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

(21) Appl. No.: 13/917,105

(22) Filed: Jun. 13, 2013

(65) Prior Publication Data

US 2013/0344423 A1 Dec. 26, 2013

(30) Foreign Application Priority Data

Jun. 14, 2012 (JP) ..... 2012-135040

(51) Int. Cl.

*G03G 5/06* (2006.01)
*G03G 5/047* (2006.01)
*G03G 5/05* (2006.01)

(52) U.S. Cl.

CPC ..... *G03G 5/047* (2013.01); *G03G 5/056* (2013.01); *G03G 5/0525* (2013.01); *G03G 5/0605* (2013.01); *G03G 5/0607* (2013.01); *G03G 5/0614* (2013.01); *G03G 5/0696* (2013.01)

(58) Field of Classification Search

CPC ... G03G 5/047; G03G 5/0696; G03G 5/0436; G03G 5/0631; G03G 5/067; G03G 5/0661
USPC ..... 430/57.3, 58.55
See application file for complete search history.

(56) References Cited

U.S. PATENT DOCUMENTS

| | | | | |
|---|---|---|---|---|
| 5,098,809 | A | 3/1992 | Kikuchi et al. | |
| 5,302,479 | A | 4/1994 | Daimon et al. | |
| 5,393,629 | A | 2/1995 | Nukada et al. | |
| 5,885,737 | A | 3/1999 | Tanaka | |
| 5,897,250 | A | 4/1999 | Hirai et al. | |
| 5,932,722 | A | 8/1999 | Hirai et al. | |
| 2008/0182197 | A1* | 7/2008 | Ogaki et al. | 430/133 |
| 2009/0136861 | A1* | 5/2009 | Mitsumori et al. | 430/66 |

(Continued)

FOREIGN PATENT DOCUMENTS

| | | | |
|---|---|---|---|
| JP | 61-238061 | A | 10/1986 |
| JP | 2-230255 | A | 9/1990 |

(Continued)

OTHER PUBLICATIONS

Machine English language translation of JP 2012042628, Mar. 1, 2012.*

(Continued)

*Primary Examiner* — Hoa V Le
(74) *Attorney, Agent, or Firm* — Oblon, McClelland, Maier & Neustadt, L.L.P.

(57) ABSTRACT

The invention provides an image forming apparatus and an electrophotographic photoreceptor, comprising: a conductive support; and at least a charge generation layer and a charge transport layer on the conductive support, wherein said charge generation layer contains a hydroxygallium phthalocyanine synthesized using a halogen solvent, said charge transport layer contains a polyester resin having a specific structural unit, and said charge transport layer is formed using a non-halogen solvent.

6 Claims, 2 Drawing Sheets

(56) References Cited

U.S. PATENT DOCUMENTS

2009/0232551 A1* 9/2009 Nagao et al. ..... 399/159
2011/0318680 A1* 12/2011 Wu ..... 430/58.8

FOREIGN PATENT DOCUMENTS

JP 2000-221713 A 8/2000
JP 3166293 B2 5/2001
JP 3639691 B2 4/2005
JP 2012042628 * 3/2012 ..... G03G 5/05

OTHER PUBLICATIONS

U.S. Appl. No. 13/783,595, filed Mar. 4, 2013, Fujii.

* cited by examiner

ELECTROPHOTOGRAPHIC PHOTORECEPTOR AND IMAGE FORMING APPARATUS

FIELD OF INVENTION

The present invention relates to an electrophotographic photoreceptor having excellent stability of image quality, particularly, in terms of humidity dependency, abrasion resistance and transfer memory, and an image forming apparatus.

BACKGROUND OF INVENTION

In association with expansion of general-purpose usage of the electrophotographic technique, an image forming apparatus employing an electrophotographic system is being used not only in office applications but also in the industrial printing field and light printing field, where an offset printing has been conventionally the mainstream. Also, along with an increasing demand for stable and mass printing of an image requiring high image quality, such as photograph, it is more strongly demanded for an electrophotographic photoreceptor (hereinafter, sometimes referred to as "photoreceptor") as a core of the electrophotography process, for example, to reduce the environmental change such as moisture or the image abnormality such as image memory, improve the abrasion resistance, and stabilize the electrostatic potential.

In order to meet these demands for the photoreceptor, various improvements have been made on the photoreceptor composition. With respect to the stability against environmental change, use of less humidity-dependent gallium phthalocyanine in place of conventionally employed titanyl phthalocyanine has been proposed (Patent Documents 1 and 2). Also, with respect to stabilization of the electrostatic potential, a charge transport material having a specific structure, among others, a triarylamine-based compound having a fluorenyl group, has been proposed (Patent Document 3). In addition, use of a polyester resin, among others, a polyarylate resin that is a generic term for a full aromatic polyester resin, in place of the conventionally employed polycarbonate resin has been proposed so as to, for example, improve abrasion resistance, improve an image defect such as filming, or improve toner transferability (Patent Document 4).

Out of image memories, as for the memory attributable to the effect of transfer load, in a reverse development system, the charge voltage and the transfer voltage are opposite in polarity and therefore, a so-called transfer memory, that is, a phenomenon where the chargeability becomes different by the effect of transfer, may be produced, giving rise to a defect such as density unevenness on image. With respect to reduction of the transfer memory, it is disclosed that a combination of specific charge transport materials works effectively (Patent Document 5).

Incidentally, the full color image forming method includes mainly a tandem system and a four-cycle system, and the transfer system on a printing medium includes, for example, a direct transfer system, a transfer drum system, an intermediate transfer system, and a multiple development-batch transfer system. Among these, a tandem system, that is, a color image forming apparatus where respective color images are formed by independent image-forming units and sequentially transferred, is an excellent image forming method, because many kinds of recording materials are usable, the full-color quality is high, and a full-color image can be obtained at a high speed.

In the case of a tandem system, high speed printing is available, but on the other hand, a system of forming respective color images by a plurality of image forming units and sequentially transferring the images is employed. Therefore, in the tandem system, the toner image transferred on a transfer medium (an intermediate transfer medium or a recording material) becomes thicker as it progresses toward the later image forming unit, and a larger transfer voltage is applied in many cases to transfer the toner layer formed on the electrophotographic photoreceptor. This brings about a tendency that charge injection into the photosensitive layer upon loading of the above-described opposite polarities is more encouraged and a clearer density difference is produced on the image depending on the site, as a result, a so-called transfer memory is liable to occur.

DOCUMENT LIST

[Patent Document 1] Japanese Patent No. 3,166,293
[Patent Document 2] Japanese Patent No. 3,639,691
[Patent Document 3] JP-A-2-230255 (the term "JP-A" as used herein means an "unexamined published Japanese patent application")
[Patent Document 4] JP-A-61-238061
[Patent Document 5] JP-A-2000-221713

SUMMARY OF THE INVENTION

Out of electrical loads during transfer, in a so-called direct transfer system where the toner on the photoreceptor is transferred directly onto a printing medium such as paper without intervention of an intermediate transfer medium, the electrical load from a transfer charger or the like on the photoreceptor becomes heavier. Specifically, when the printing medium has various sizes and printing on a small-size paper sheet such as envelope-like printing medium is performed in the longitudinal direction of the paper sheet, a transfer voltage applied from the back of the printing medium is partially applied directly to the photoreceptor, because the printing medium is small. For example, when envelope-like printing mediums are continuously printed vertically with respect to the progressing direction of printing, a transfer voltage by far stronger than in the printing medium-passing portion is continuously applied to a photoreceptor portion uninvolved in printing without intervention of a printing medium, as a result, an irreversible persistent change may be given to the electrical characteristics of the photoreceptor. In such a case, when a large-size printing medium is thereafter printed, a clear difference in image density is generated between the portion where the envelope-like printing medium passed and the portion where the medium did not pass, and a more serious image defect such as band-like white void may be produced. This defect is a kind of so-called transfer memory but, among others, is a most persistent image defect, and unlike an image memory, for example, attributable to a simple temporary accumulation of charges and erasable with aging (for example, when left on overnight), it can be hardly expected that the defect above fades as time passes. Therefore, the measure against this defect is important.

The present invention has been made taking these problems into consideration, and an object of the present invention is to provide an image forming apparatus and an electrophotographic photoreceptor where a persistent transfer memory is not produced even in a direct transfer system and at the same time, the stability of photoreceptor potential and the abrasion resistance of photoreceptor are excellent.

MEANS FOR SOLVING THE PROBLEMS

As a result of intensive studies, the present inventors have found that when a charge transport layer using a charge generating material synthesized under specific conditions, a specific polyester resin and a specific coating solvent is employed, a transfer memory is not produced even in a direct transfer system and at the same time, the photoreceptor exhibits excellent stability of photoreceptor potential and excellent abrasion resistance. The present invention described below has been accomplished based on this finding.

The gist of the present invention resides in the following <1> to <7>.

<1> An electrophotographic photoreceptor comprising: a conductive support; and at least a charge generation layer and a charge transport layer on the conductive support, wherein said charge generation layer contains a hydroxygallium phthalocyanine synthesized using a halogen solvent, said charge transport layer contains a polyester resin having a structural unit represented by the following formula (6), and said charge transport layer is formed using a non-halogen solvent:

(6)

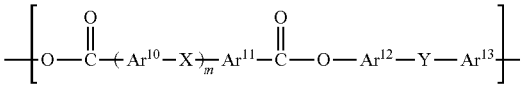

wherein each of $Ar^{10}$ to $Ar^{13}$ independently represents an arylene group which may have a substituent, X represents a single bond, an oxygen atom, a sulfur atom or an alkylene group, m represents an integer of 0 to 2, and Y represents a single bond, an oxygen atom, a sulfur atom or an alkylene group.

<2> The electrophotographic photoreceptor as described in the item <1>, wherein said gallium phthalocyanine is a V-type hydroxygallium phthalocyanine.

<3> The electrophotographic photoreceptor as described in the item <1> or <2>, wherein said charge transport layer contains a charge transport substance represented by the following formula (1) and said charge transport layer is formed using only a non-halogen solvent:

(1)

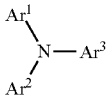

wherein each of $Ar^1$ and $Ar^2$ independently represents an aryl group having a carbon number of 30 or less, which may have a substituent, and $Ar^a$ represents a fluorenyl group having a carbon number of 30 or less, which may have a substituent.

<4> The electrophotographic photoreceptor as described in any one of the items <1> to <3>, wherein said charge transport layer contains a charge transport substance represented by the following formula (2):

(2)

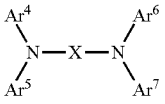

wherein each of $Ar^4$ to $Ar^7$ independently represents an aryl group having a carbon number of 30 or less, which may have a substituent, and X represents a divalent substituent represented by formula (3) or (4):

(3)

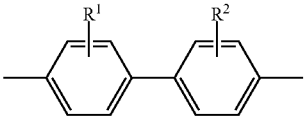

(4)

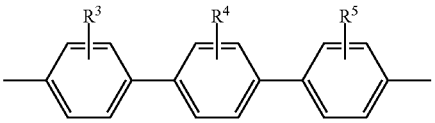

wherein each of $R^1$ to $R^5$ independently represents a hydrogen atom or an alkyl group having a carbon number of 6 or less; provided that when X is the divalent substitute represented by the formula (3) and all of $Ar^4$ to $Ar^7$ in the formula (2) are each independently a phenyl group which may have a substituent, each of $Ar^4$ and $Ar^6$ independently has at least one substituent on the ortho-position or para-position with respect to the nitrogen atom; and the substituents in $Ar^4$ to $Ar^7$ may combine with each other to form a ring.

<5> An electrophotographic photoreceptor comprising: a conductive support; and at least a charge generation layer and a charge transport layer on the conductive support, wherein said charge generation layer contains a-chloronaphthalene and a hydroxygallium phthalocyanine, said charge transport layer contains a polyester resin having a structural unit represented by the following formula (6), and said charge transport layer is formed using a non-halogen solvent:

(6)

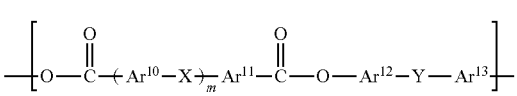

wherein each of $Ar^{10}$ to $Ar^{13}$ independently represents an arylene group which may have a substituent, X represents a single bond, an oxygen atom, a sulfur atom or an alkylene group, m represents an integer of 0 to 2, and Y represents a single bond, an oxygen atom, a sulfur atom or an alkylene group.

<6> The electrophotographic photoreceptor as described in the item <5>, wherein the content of said a-chloronaphthalene is from 0.2 to 1.0 ng/cm$^2$ and the content of chlorobenzene in the charge transport layer is 0.2 ng/cm$^2$ or less.

<7> An image forming apparatus comprising an electrophotographic photoreceptor, wherein the electrophotographic photoreceptor comprises: a conductive support; and at least a charge generation layer and a charge transport layer on the conductive support, said charge generation layer contains a gallium phthalocyanine synthesized using a halogen solvent, said charge transport layer contains a polyester resin, a non-halogen solvent is used in a coating solution for forming said charge transport layer, and in an electrophotographic process, a toner developed on said electrophotographic photoreceptor is directly transferred onto a printing medium without intervention of an intermediate transfer member.

The present invention can provide an image forming apparatus ensuring that in an electrophotographic process where a toner developed on a photoreceptor is directly transferred onto a printing medium without intervention of an intermediate transfer member, abrasion resistance, image stability against humidity change or the like, and image memory resistance are excellent and particularly an image defect attributable to transfer, such as transfer white void near the photoreceptor edge, is hardly produced.

DESCRIPTION OF REFERENCE NUMERALS AND SIGNS

Figure 1:
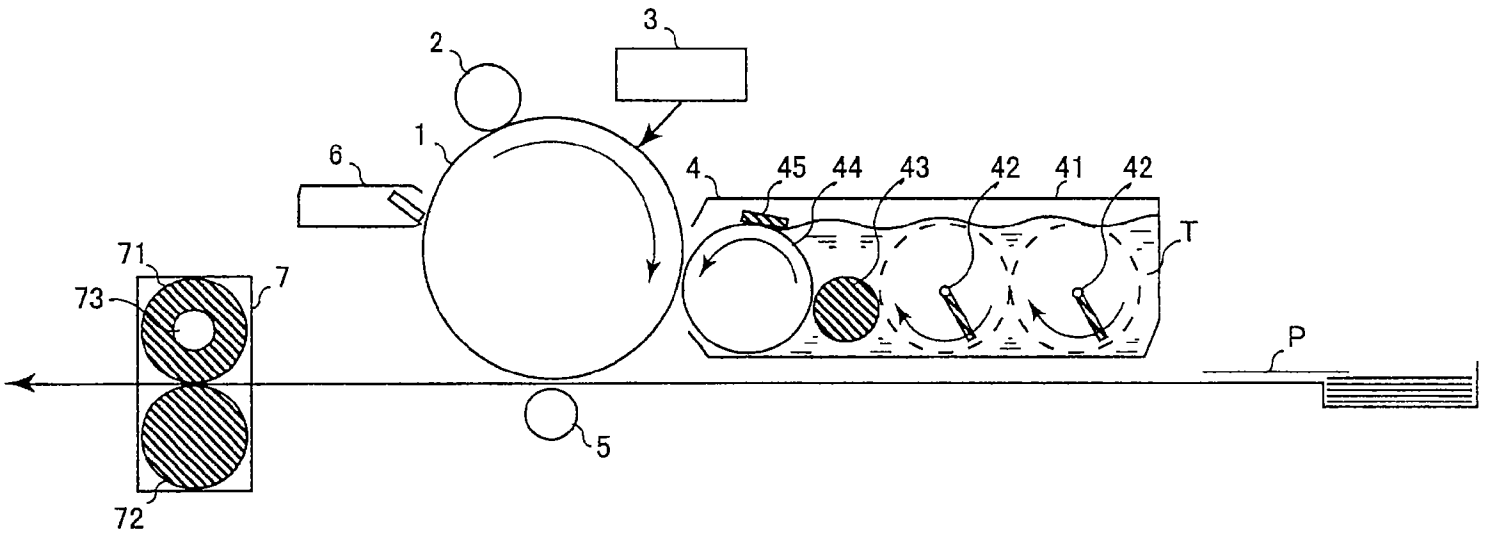
FIG. 1 is a schematic view illustrating the configuration of main parts in one embodiment of the image forming apparatus of the present invention.

1 Photoreceptor (electrophotographic photoreceptor)
2 Charging device (charging roller; charging unit)
3 Exposure device (exposure unit)
4 Developing device (developing unit)
5 Transfer device
6 Cleaning device
7 Fixing device
41 Developing tank
42 Agitator
43 Feed roller
44 Developing roller
45 Regulating member
71 Upper fixing member (fixing roller)
72 Lower fixing member (fixing roller)
73 Heating device
T Toner
P Recording paper (paper, medium)

DETAILED DESCRIPTION OF THE INVENTION

The mode for carrying out the present invention is described in detail below, but the constituent requirements described below are representative examples of the embodiment of the present invention, and the present invention can be implemented by making appropriate modifications therein without departing from the purport of the present invention.

<Electrophotographic Photoreceptor>

The configuration of the electrophotographic photoreceptor of the present invention is described below. The electrophotographic photoreceptor of the present invention is a laminate-type photoreceptor comprising a conductive support having thereon at least a charge generation layer and a charge transport layer in this order.

<Conductive Support>

The conductive support is not particularly limited, but examples of the support which is mainly used include a metal material such as aluminum, aluminum alloy, stainless steel, copper and nickel; a resin material in which an electrically conductive powder such as metal, carbon and tin oxide is added to impart electrical conductivity; and a resin, glass or paper, on which surface an electrically conductive material such as aluminum, nickel and ITO (indium tin oxide) is deposited or coated. One of these materials may be used alone, or two or more thereof may be used in combination by employing an arbitrary combination and an arbitrary ratio. As for the form of the conductive support, a support in the form of, for example, a drum, a sheet or a belt is used. Furthermore, an electroconductive support made of a metal material, on which an electrically conductive material having an appropriate resistance value is coated to control the electrical conductivity, surface property or the like or cover a defect, may be also used.

In the case where a metal material such as aluminum alloy is used as the conductive support, the metal material may be used after an anodic oxide film is applied thereto. When an anodic oxide film is applied, it is preferred to apply a sealing treatment by a known method.

The conductive support surface may be smooth or may be roughened by using a special cutting method or applying a polishing treatment. The roughening may be also achieved by mixing a particle having an appropriate particle diameter in the material constituting the conductive support. In addition, in order reduce the cost, it may be also possible to use a drawn pipe as it is without applying a cutting treatment.

<Undercoat Layer>

A undercoat layer may be provided between the conductive support and the later-described photosensitive layer so as to improve adhesive property, blocking property and the like. As the undercoat layer, for example, a resin or a resin having dispersed therein a particle such as metal oxide particle is used. The undercoat layer may be composed of a single layer or a plurality of layers.

Examples of the metal oxide particle used in the undercoat layer include a metal oxide particle containing one metal element, such as titanium oxide, aluminum oxide, silicon oxide, zirconium oxide, zinc oxide and iron oxide, and a metal oxide particle containing a plurality of metal elements, such as calcium titanate, strontium titanate and barium titanate. Of these metal oxide particles, one kind of a particle may be used alone, or a plurality of kinds of particles may be mixed and used. Among these metal oxide particles, titanium oxide and aluminum oxide are preferred, and titanium oxide is more preferred. The surface of the titanium oxide particle may be subjected to a treatment with an inorganic material such as tin oxide, aluminum oxide, antimony oxide, zirconium oxide and silicon oxide, or with an organic material such as stearic acid, polyol and silicone. As for the crystal form of the titanium oxide particle, any of rutile, anatase, brookite and amorphous may be used. Also, a plurality of crystal forms may be contained.

As for the particle diameter of the metal oxide particle, those having various particle diameters may be used but above all, in view of characteristics and liquid stability, the average primary particle diameter thereof is preferably from 10 to 100 nm, more preferably from 10 to 50 nm. This average primary particle diameter can be obtained using a TEM photograph or the like.

The undercoat layer is preferably formed in the form of a metal oxide particle being dispersed in a binder resin. The binder resin used in the undercoat layer includes an epoxy resin, a polyethylene resin, a polypropylene resin, an acrylic resin, a methacrylic resin, a polyamide resin, a vinyl chloride resin, a vinyl acetate resin, a phenol resin, a polycarbonate resin, a polyurethane resin, a polyimide resin, a vinylidene chloride resin, a polyvinyl acetal resin, a vinyl chloride-vinyl acetate copolymer, a polyvinyl alcohol resin, a polyurethane resin, a polyacrylic resin, a polyacrylamide resin, a polyvinylpyrrolidone resin, a polyvinylpyridine resin, a water-soluble polyester resin, a cellulose ester resin such as nitrocellulose, a cellulose ether resin, casein, gelatin, a polyglutamic acid, starch, a starch acetate, an amino starch, an organic zirconium compound such as zirconium chelate compound and zirconium alkoxide compound, an organic titanyl compound such as titanyl chelate compound and titanyl alkoxide compound, a silane coupling agent, and other known binder resins. One of these binder resins may be used alone, or two or more thereof may be used in combination by employing an arbitrary combination and an arbitrary ratio. The binder resin may be also used in the form of being hardened together with a hardening agent. Among others, for example, an alcohol-soluble copolymerized polyamide or modified polyamide is preferred because this binder resin exhibits good dispersibility and coatability.

The use ratio of the inorganic particle to the binder resin used in the undercoat layer may be arbitrarily selected, but in view of stability and coatability of the liquid dispersion, the inorganic particle is preferably used in a ratio of usually from 10 to 500 mass % based on the binder resin.

The film thickness of the undercoat layer may be arbitrary as long as the effects of the present invention are not seriously impaired, but from the standpoint of enhancing electrical characteristics, intense exposure characteristics, image characteristics and repetition characteristics of the electrophotographic photoreceptor as well as coatability at the production, the film thickness is usually 0.01 μm or more, preferably 0.1 μm or more, and usually 30 μm or less, preferably 20 μm or less. In the undercoat layer, a known antioxidant and the like may be mixed. Also, for example, a pigment particle or a resin particle may be incorporated into the undercoat layer for the purpose of preventing an image defect or the like.

<Photosensitive Layer>

The photosensitive layer is formed on the above-described conductive support (in the case of providing the above-described undercoat layer, on the undercoat layer). The photosensitive layer is a laminate-type photosensitive layer formed by providing, in order, a charge generation layer and a charge transport layer from the conductor support side.

<Charge Generation Layer>

The charge generation layer of the laminate-type photosensitive layer (function separation-type photosensitive layer) contains a charge generating substance and at the same time, usually contains a binder resin and other components which are used, if desired. Such a charge generation layer can be obtained, for example, by dissolving or dispersing a charge generating substance and a binder resin in a solvent or a dispersion medium to produce a coating solution, and applying and drying the coating solution, in the case of a forward laminate-type photosensitive layer, on a conductive support (when providing a undercoat layer, on the undercoat layer), and in the case of a reverse laminate-type photosensitive layer, on a charge transport layer.

As the charge generating substance, a gallium phthalocyanine that is low in humidity dependency and can increase the sensitivity is used. Among others, for example, a II-type chlorogallium phthalocyanine, a V-type hydroxygallium phthalocyanine, a hydroxygallium phthalocyanine having a strongest peak at 28.1°, a hydroxygallium phthalocyanine having no peak at 26.2° and having a clear peak at 28.1°, which is characterized in that the half-value width W of 25.9° is $0.1° \leq W \leq 0.4°$, and a G-type μ-oxo-gallium phthalocyanine dimer are more preferred, and a V-type hydroxygallium phthalocyanine is most preferred.

For the synthesis of a gallium phthalocyanine, a halogen-based solvent is used. The halogen-based solvent includes fluorine-based, chlorine-based, bromine-based and iodine-based solvents, and in view of safety and supply stability, a chlorine-based or bromine-based solvent is preferred. Also, the halogen-based solvent includes an aliphatic halogen-based compound and an aromatic halogen-based compound. Specific examples of the aliphatic halogen-based compound include methyl chloride, dichlorobenzene, chloroform, carbon tetrachloride, dichloroethane, carbon bromide, trifluoroalcohol, and trifluoroacetic acid. Specific examples of the aromatic halogen-based compound include monohalogenated naphthalenes such as fluoronaphthalene, chloronaphthalene, bromonaphthalene and iodonaphthalene, dihalogenated naphthalenes such as difluoronaphthalene, dichloronaphthalene, dibromonaphthalene and diiodonaphthalene, and monohalogenated benzenes such as chlorobenzene, bromobenzene and iodobenzene. Among these, in view of reactivity at the synthesis, a monohalogenated naphthalene and a monohalogenated benzene are preferred. In view of difficulty in producing a by-product during the synthesis reaction, chlorobenzene, chloronaphthalene and bromonaphthalene are more preferred. In the case of naphthalenes, a solvent having a halogen at the 1-position is preferred.

As for the boiling point of the halogen-based solvent, the lower limit is usually 120° C. or more, preferably 150° C. or more, in consideration of the yield of synthesis reaction, and the upper limit is usually 400° C. or less, preferably 300° C. or less, from the standpoint of decreasing the residual amount in the product.

Representative examples of the production method for a gallium phthalocyanine include the method described in Patent Document 1 where a gallium phthalocyanine is produced from 1,3-diiminoisoindoline and gallium trichloride by using quinoline or the like as the reaction solvent, and the method described in Patent Document 2 where a gallium phthalocyanine is produced from o-phthalonitrile and gallium trichloride by using chloronaphthalene or bromonaphthalene as the reaction solvent. Of these, the method of producing a gallium phthalocyanine from o-phthalonitrile and gallium trichloride by using a halogen-based solvent as the reaction solvent is preferred, because a halogen-based solvent slightly remains in the phthalocyanine crystal produced and the later-described transfer memory is thereby improved. On the other hand, in the method of producing a gallium phthalocyanine from 1,3-diiminoisoindoline and gallium trichloride by using a non-halogen solvent such as quinoline for the reaction solvent, 1,3-diiminoisoindoline is unstable to heat or light and readily decomposes to decrease in the purity, leading to a decrease in the purity of the synthesized gallium phthalocyanine and causing a problem in the electrical characteristics, and this method is not preferred also in view of transfer memory.

In the case where the organic pigment exemplified above is used as the charge generating substance, one kind of an organic pigment may be used, or two or more kinds of pigments may be mixed and used. In this case, two or more kinds of charge generating substances having spectral sensitivity characteristics in different spectral regions of visible region and near infrared region are preferably used in combination, and it is more preferred to use a disazo pigment, a trisazo pigment and a phthalocyanine pigment in combination.

The binder resin used in the charge generation layer constituting the laminate-type photosensitive layer is not particularly limited, but examples thereof include an insulating resin, for example, a polyvinylacetal-based resin such as polyvinylbutyral resin, polyvinylformal resin and partially acetalized polyvinylbutyral resin in which butyral is partially modified with formal, acetal or the like, a polyarylate resin, a polycarbonate resin, a polyester resin, a modified ether-based polyester resin, a phenoxy resin, a polyvinyl chloride resin, a polyvinylidene chloride resin, a polyvinyl acetate resin, a polystyrene resin, an acrylic resin, a methacrylic resin, a polyacrylamide resin, a polyamide resin, a polyvinylpyridine resin, a cellulose-based resin, a polyurethane resin, an epoxy resin, a silicone resin, a polyvinyl alcohol resin, a polyvinylpyrrolidone resin, casein, a vinyl chloride-vinyl acetate-based copolymer such as vinyl chloride-vinyl acetate copolymer, hydroxy-modified vinyl chloride-vinyl acetate copolymer, carboxyl-modified vinyl chloride-vinyl acetate copolymer and vinyl chloride-vinyl acetate-maleic anhydride copolymer, a styrene-butadiene copolymer, a vinylidene chloride-acrylonitrile copolymer, a styrene-alkyd resin, a silicon-alkyd resin, and a phenol-formaldehyde resin; and an organic photoconductive polymer such as poly-N-vinylcarbazole, polyvinylanthracene and polyvinylperylene. Any one of these binder resins may be used alone, or two or more kinds thereof may be used as a mixture in arbitrary combination.

The charge generation layer is specifically formed by dispersing a charge generating substance in a solution resulting from dissolving the above-described binder resin in an organic solvent, to prepare a coating solution and applying the coating solution on a conductive support (in the case of providing a undercoat layer, on the undercoat layer).

The solvent used for the preparation of the coating solution is not particularly limited as long as it dissolves the binder resin, but examples thereof include a saturated aliphatic solvent such as pentane, hexane, octane and nonane, an aromatic solvent such as toluene, xylene and anisole, a halogenated aromatic solvent such as chlorobenzene, dichlorobenzene and chloronaphthalene, an amide-based solvent such as dimethylformamide and N-methyl-2-pyrrolidone, an alcohol-based solvent such as methanol, ethanol, isopropanol, n-butanol and benzyl alcohol, aliphatic polyhydric alcohols such as glycerin and polyethylene glycol, a chain or cyclic ketone-based solvent such as acetone, cyclohexanone, methyl ethyl ketone and 4-methoxy-4-methyl-2-pentanone, an ester-based solvent such as methyl formate, ethyl acetate and n-butyl acetate, a halogenated hydrocarbon-based solvent such as methylene chloride, chloroform and 1,2-dichloroethane, a chain or cyclic ether-based solvent such as diethyl ether, dimethoxyethane, tetrahydrofuran, 1,4-dioxane, methyl cellosolve and ethyl cellosolve, an aprotic polar solvent such as acetonitrile, dimethylsulfoxide, sulfolane and hexamethylphosphoric acid triamide, a nitrogen-containing compound such as n-butylamine, isopropanolamine, diethylamine, triethanolamine, ethylenediamine, triethylenediamine and triethylamine, a mineral oil such as ligroin, and water. Any one of these solvents may be used alone, or two or more thereof may be used in combination. Incidentally, in the case of providing the above-described undercoat layer, a solvent that does not dissolve the undercoat layer is preferred.

Incidentally, it is not necessarily easy for the solvent used in the production of the coating solution to impregnate the gallium phthalocyanine crystal, and as compared with the solvent used in the production of the gallium phthalocyanine, the effect of improving the later-described transfer memory is considered to be small. From the standpoint of preventing an accumulation of positive charges during the later-described transfer load, the solvent used in the production of the coating solution for the charge transport layer is preferably a non-halogen solvent. However, the film thickness of the charge generation layer is sufficiently small as compared with the charge transport layer and therefore, as long as a halogen solvent having a high boiling point is not used, the solvent is considered to have not so high an effect as the solvent in the coating solution for the charge transport layer.

The content of the halogen solvent in the charge generation layer is preferably from 0.2 to 1.0 ng/cm$^2$. The content of the halogen solvent in the charge generation layer is preferably 0.2 ng/cm$^2$ or more, more preferably 0.3 ng/cm$^2$ or more, and particularly preferably 0.4 ng/cm$^2$ or more, and the content of the halogen solvent in the charge generation layer is preferably 1.0 ng/cm$^2$ or less, more preferably 0.9 ng/cm$^2$ or less, and particularly preferably 0.8 ng/cm$^2$ or less. Above all, in view of charge generation efficiency, the content of α-chloronaphthalene is preferably from 0.2 to 1.0 ng/cm$^2$.

In the charge generation layer, as for the blending ratio (mass ratio) between the binder resin and the charge generating substance, the ratio of the charge generating substance is usually 10 parts by mass or more, preferably 30 parts by mass or more, and usually 1,000 parts by mass or less, preferably 500 parts by mass or less, per 100 parts by mass of the binder resin. The film thickness of the charge generation layer is usually 0.1 μm or more, preferably 0.15 μm or more, and usually 10 μm or less, preferably 0.6 μm or less. If the ratio of the charge generating substance is too high, the coating solution may be reduced in the stability due to aggregation or the like of the charge generating substance, whereas if the ratio of the charge generating substance is too low, this may incur reduction in the sensitivity as a photoreceptor.

As the method for dispersing the charge generating substance, a known dispersion method such as ball mill dispersion method, attritor dispersion method and sand mill dispersion method may be employed. At this time, it is effective to pulverize the particle to a particle size of 0.5 μm or less, preferably 0.3 μm or less, more preferably 0.15 μm or less.

<Charge Transport Layer>

The charge transport layer of the laminate-type photoreceptor contains a charge transport substance, a binder resin, and other components which are used, if desired. The charge transport layer can be obtained specifically by dissolving or dispersing a charge transport substance or the like and a binder resin in a solvent to prepare a coating solution, and applying and drying the coating solution, in the case of a forward laminate-type photosensitive layer, on a charge generation layer and in the case of a reverse laminate-type photosensitive layer, on a conductive support (when providing a undercoat layer, on the undercoat layer).

As the charge transport substance, known compounds, for example, a carbazole derivative, a hydrazone derivative, an aromatic amine derivative, a styryl derivative, an enamine derivative, a butadiene derivative, and a compound formed by bonding a plurality of these derivatives, can be used. Among these, an aromatic amine derivative is preferred, and an aromatic amine derivative represented by the following formula (1) is most preferred.

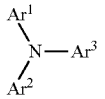

(1)

In formula (1), $Ar^1$ and $Ar^2$ each independently represents an arylene group having a carbon number of 30 or less, which may have a substituent. The carbon number of the aryl group is 30 or less, preferably 20 or less, more preferably 15 or less. Specific examples thereof include a phenyl group, a naphthyl group, an anthranyl group, and a pyrenyl group. In view of synthesis, a phenyl group or a naphthyl group is preferred, and a phenyl group is most preferred. The total carbon number of the substituents which may be substituted on $Ar^1$ and $Ar^2$ is 30 or less and in view of solubility and synthesis, preferably 20 or less, more preferably 10 or less. Specific examples of the substituent include an alkyl group, an alkoxy group, an amino group, and an aryl group, and among these, in view of electrical characteristics, an alkyl group is preferred. The carbon number of the alkyl group is 10 or less, preferably 6 or less, more preferably 4 or less. The substitution position is preferably the ortho-position with respect to the nitrogen atom in view of light-induced fatigue and is preferably the para-position in view of electrical characteristics.

In formula (1), $Ar^3$ represents a fluorenyl group which may have a substituent. The bonding position of the fluorenyl group is, as shown in formula (5), preferably a 6-membered ring moiety.

(5)

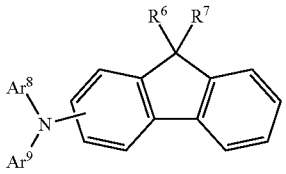

In formula (5), each of $Ar^8$ and $Ar^9$ independently represents an aryl group having a carbon number of 30 or less, which may have a substituent, and each of $R^6$ and $R^7$ independently represents a hydrogen atom or an alkyl group having a carbon number of 6 or less. In formula (5), each of $Ar^8$ and $Ar^9$ independently represents an aryl group having a carbon number of 30 or less, which may have a substituent. The carbon number of the aryl group is 30 or less, preferably 20 or less, more preferably 15 or less. Specific examples thereof include a phenyl group, a naphthyl group, an anthranyl group, and a pyrenyl group. In view of synthesis, a phenyl group or a naphthyl group is preferred, and a phenyl group is most preferred. The total carbon number of the substituent which may be substituted on $Ar^8$ and $Ar^9$ is 30 or less and in view of solubility and synthesis, preferably 20 or less, more preferably 10 or less. Specific examples thereof include an alkyl group, an alkoxy group, an amino group, and an aryl group, and among these, in view of electrical characteristics, an alkyl group is preferred. The carbon number of the alkyl group is 10 or less, preferably 6 or less, more preferably 4 or less. The substitution position is preferably the ortho-position with respect to the nitrogen atom in view of light fatigue and is preferably the para-position in view of electrical characteristics.

In $R^6$ and $R^7$, the carbon number of the alkyl group is 6 or less, preferably 4 or less, more preferably 3 or less. The alkyl group specifically includes a linear alkyl group such as methyl group, ethyl group and propyl group, a branched alkyl group such as isopropyl group, tert-butyl group and isobutyl group, and a cyclic alkyl group such as cyclohexyl group and cyclopentyl group. Among these, in view of synthesis, a methyl group or an ethyl group is preferred, and a methyl group is most preferred. In view of chemical stability, $R^6$ and $R^7$ both are preferably an alkyl group having a carbon number of 6 or less, more preferably an alkyl group having a carbon number of 4 or less, and most preferably a methyl group.

Also, in view of transfer memory, the charge transport substance represented by formula (1) is preferably used by mixing it with a charge transport substance represented by formula (2).

(2)

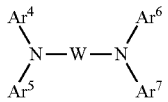

In formula (2), W represents a divalent substituent represented by formula (3) or (4):

(3)

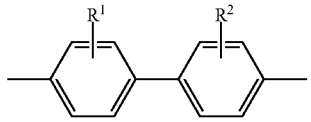

(4)

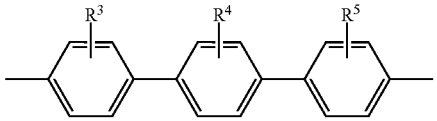

Each of $R^1$ to $R^5$ represents a hydrogen atom or an alkyl group having a carbon number of 4 or less. In $R^1$ to $R^5$, the carbon number of the alkyl group is 4 or less, preferably 3 or less. The alkyl group specifically includes a linear alkyl group such as methyl group, ethyl group and propyl group, a branched alkyl group such as isopropyl group, tert-butyl group and isobutyl group, and a cyclic alkyl group such as cyclohexyl group and cyclopentyl group. Among these, in view of synthesis, a methyl group or an ethyl group is preferred, and a methyl group is most preferred. The substitution number of alkyl groups is, per one benzene ring, preferably 2 or less, more preferably 1 or less, and most preferably 0, that is, all are a hydrogen atom.

In formula (2), each of $Ar^4$ to $Ar^7$ independently represents an aryl group having a carbon number of 30 or less, which may have a substituent. The carbon number of the aryl group is 30 or less, preferably 20 or less, more preferably 15 or less. Specific examples thereof include a phenyl group, a naphthyl group, an anthranyl group and a pyrenyl group. In view of synthesis, a phenyl group or a naphthyl group is preferred; in view of crack resistance, a naphthyl group is most preferred; and in view of ease of production, a phenyl group is most preferred. The total carbon number of the substituents which may be substituted on $Ar^4$ to $Ar^7$ is 30 or less and in view of solubility and synthesis, preferably 20 or less, more preferably 10 or less. Specific examples of the substituent include an alkyl group, an alkoxy group, an amino group, and an aryl group. Among these, an alkyl group or an alkoxy group is preferred in view of low residual potential, and an alkyl group is preferred in view of responsivity. The carbon number of the alkyl group is 6 or less, preferably 4 or less, more preferably 3 or less. The alkyl group specifically includes a linear alkyl group such as methyl group, ethyl group and propyl group, a branched alkyl group such as isopropyl group, tert-butyl group and isobutyl group, and a cyclic alkyl group such as cyclohexyl group and cyclopentyl group. Among these, in view of synthesis, a methyl group is most preferred. Also, the substituents may combine with each other to form a ring. For example, two alkyl groups may circularly combine to form a cycloalkyl group or may be ester-crosslinked to form a lactone or the like. The number of substituents is, per one aryl group, usually 3 or less, preferably 2 or less. The total number of substituents on $Ar^4$ to $Ar^7$ is usually 8 or less, preferably 6 or less, and is usually 0 or more, preferably 2 or more.

In the case where each of $Ar^4$ to $Ar^7$ is independently a phenyl group having a carbon number of 30 or less, which may have a substituent, the substitution position of the substituent which may be substituted on is preferably the ortho-position with respect to the nitrogen atom in view of light-induced fatigue, preferably the para-position in view of electrical characteristics, and preferably the meta position in view of solubility. Also, in view of crack resistance, each of $Ar^4$ and $Ar^6$ preferably has at least one substituent on the ortho-position or para-position with respect to the nitrogen atom.

The mixing ratio between the charge transport substance represented by formula (1) and the charge transport substance represented by formula (2) is usually from 20:80 to 95:5, preferably from 30:70 to 90:10, more preferably from 40:60 to 90:10. If the proportion of the charge transport substance represented by formula (1) is too large, the crack resistance may be deteriorated, whereas if the proportion of the charge transport substance represented by formula (2) is too large, the solubility may be deteriorated to cause precipitation of the substance in the photosensitive layer and this may affect the electrical characteristics, particularly, responsivity.

The total amount of the charge transport substance represented by formula (1) and the charge transport substance represented by formula (2) is, in terms of the weight per 100 parts by weight of the binder resin, in view of electrical characteristics, usually 40 parts by weight or more, preferably 60 parts by weight or more, more preferably 70 parts by weight or more, and in view of crack resistance and wear resistance, usually 150 parts by weight or less, preferably 120 parts by weight or less, more preferably 110 parts by weight or less.

Examples of the structures of the charge transport substances represented by formulae (1) and (2) suitable for the present invention are illustrated below. The following structures are examples for more specifically illustrating the present invention, and the present invention is not limited to these structures as long as the concept of the present invention is observed.

(1)-1

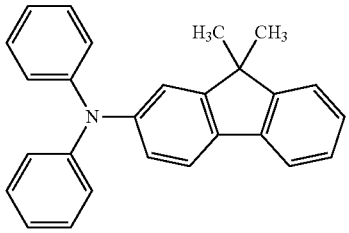

(1)-2

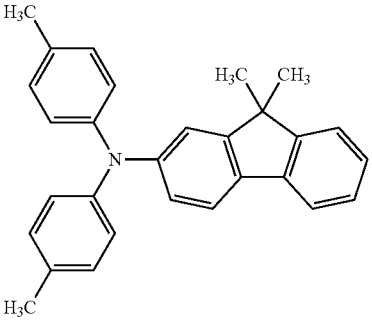

(1)-3

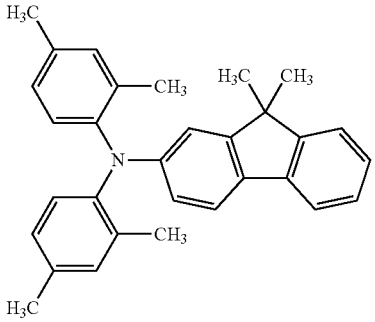

(1)-4

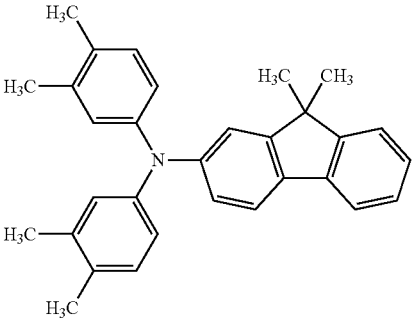

(1)-5

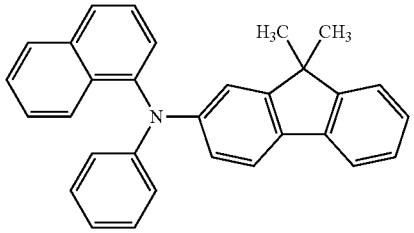

(1)-6

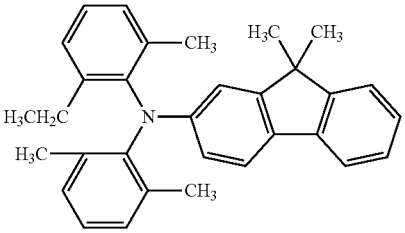

(1)-7

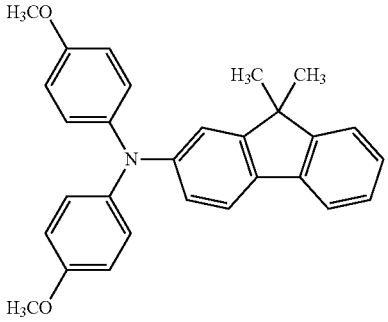

(1)-8

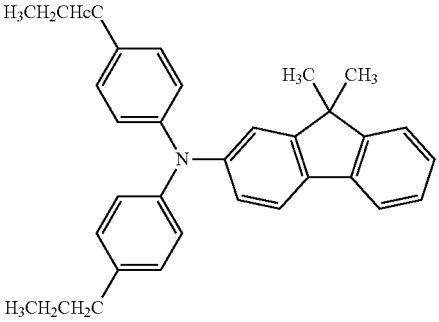

-continued
(1)-9
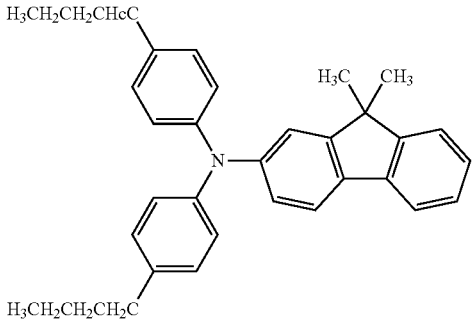
(1)-10
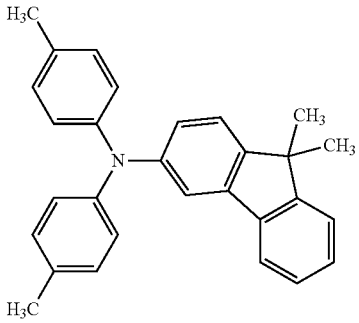
(1)-11
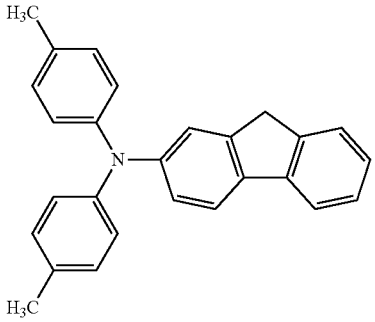
(1)-12
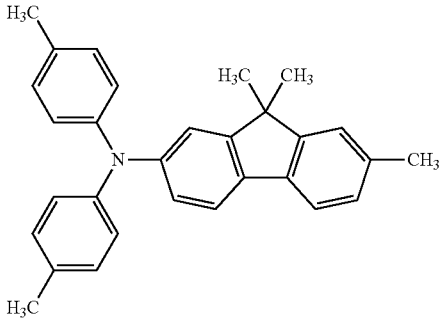
(2)-1
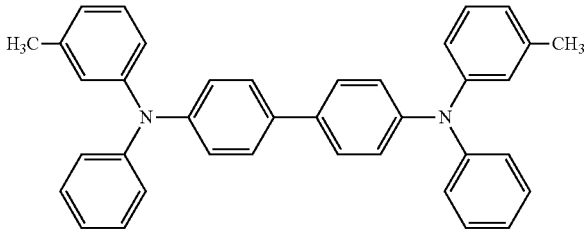
(2)-2
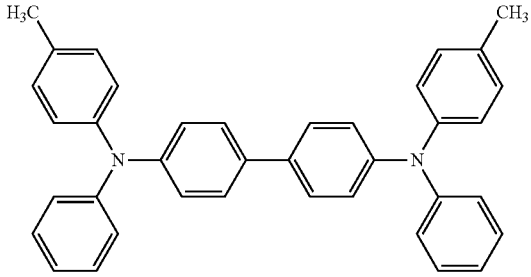
(2)-3
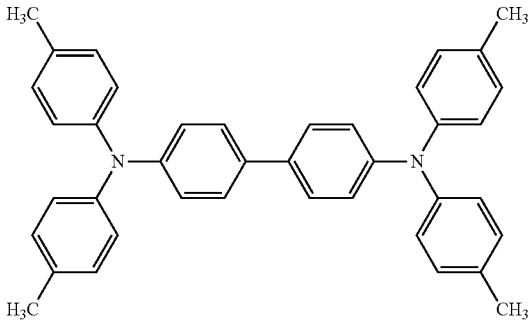
(2)-4
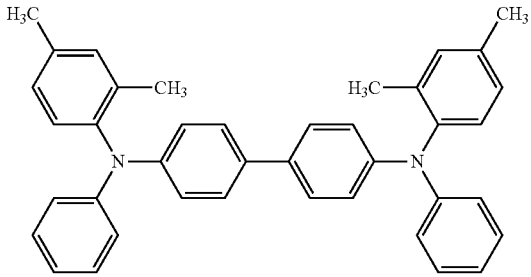
(2)-5
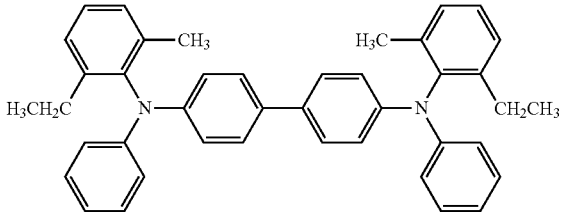
(2)-6
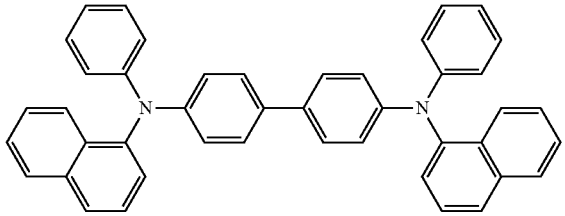

-continued
(2)-7
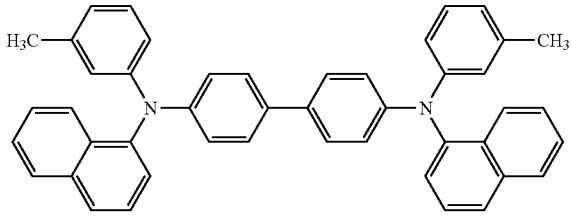
(2)-8
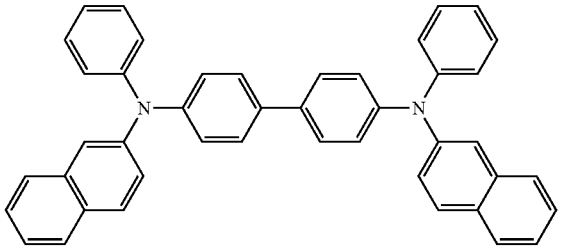
(2)-9
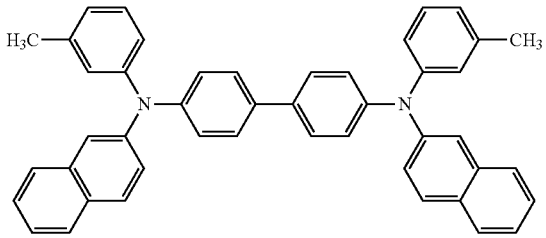
(2)-10
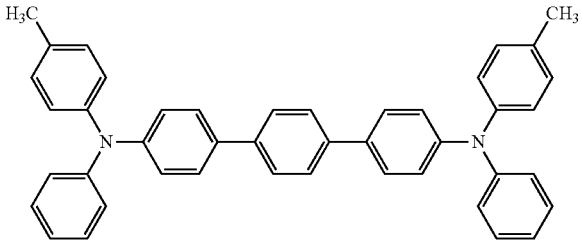
(2)-11
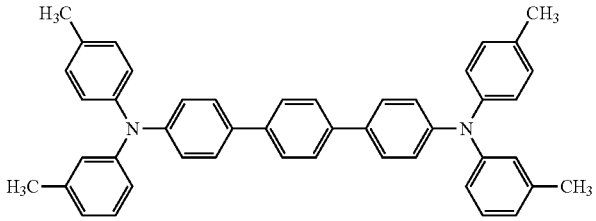
(2)-12
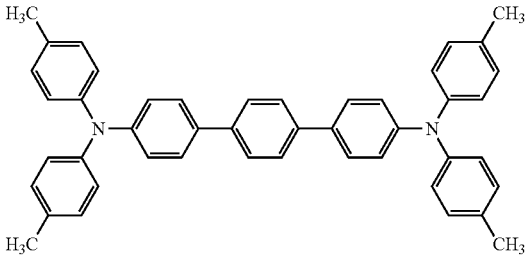
(2)-13
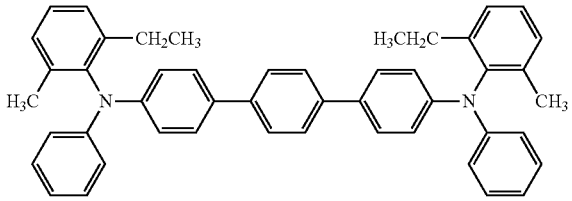
(2)-14
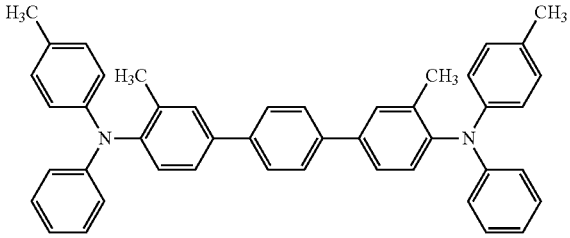
(2)-15
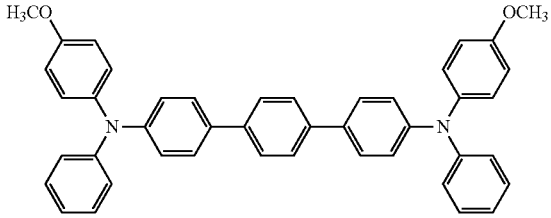
(2)-16
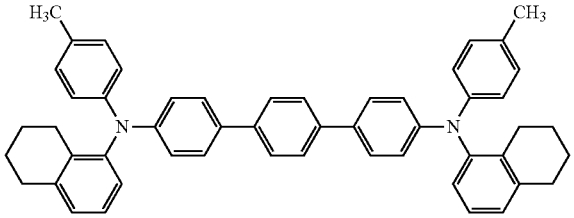

-continued (2)-17

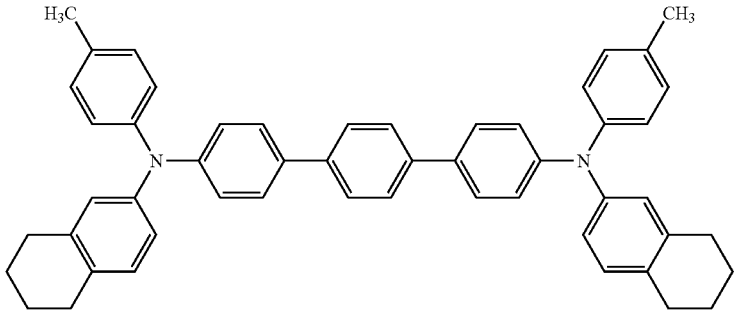

(2)-18

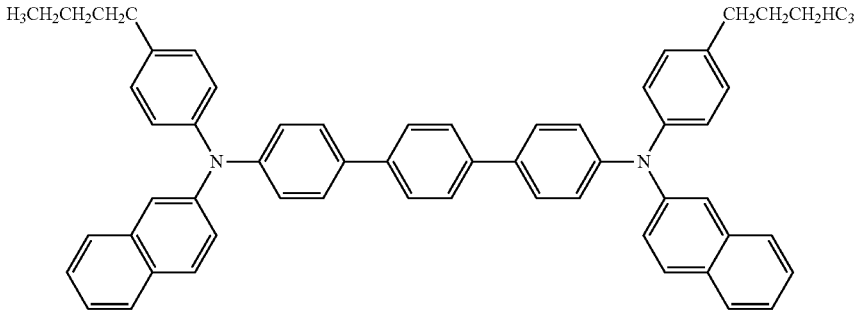

The binder resin is used so as to secure the film strength. The photoreceptor of the present invention contains a polyester resin as the binder resin of the charge transport layer. The polyester resin can have a higher elastic deformation ratio than a polycarbonate resin and is preferred in view of abrasion resistance, filming resistance, crack resistance and toner transferability. Among polyester resins, a polyarylate resin that is a full aromatic polyester resin is more preferred. In the case of the later-described direct transfer system, as the polyester resin, any polyester resin can be used as long as it is thermoplastic and soluble in an organic solvent.

The polyester resin is described below. In general, the polyester resin is obtained by condensation-polymerizing, as raw material monomers, a polyhydric alcohol component and a polyvalent carboxylic acid component such as carboxylic acid, carboxylic anhydride and carboxylic acid ester.

Examples of the polyhydric alcohol component include an alkylene (carbon number: from 2 to 3) oxide (average number of added moles: from 1 to 10) adduct of bisphenol A, such as polyoxypropylene (2.2)-2,2-bis(4-hydroxyphenyl)propane and polyoxyethylene (2.2)-2,2-bis(4-hydroxyphenyl)propane, ethylene glycol, propylene glycol, neopentyl glycol, glycerin, pentaerythritol, trimethylolpropane, hydrogenated bisphenol A, sorbitol, an alkylene (carbon number: from 2 to 3) oxide (average number of added moles: from 1 to 10) adduct thereof, and an aromatic bisphenol. A component containing one or more of these members is preferred.

Examples of the polyvalent carboxylic acid component include a dicarboxylic acid such as phthalic acid, isophthalic acid, terephthalic acid, fumaric acid and maleic acid, a succinic acid substituted with an alkyl group having a carbon number of 1 to 20 or an alkenyl group having a carbon number of 2 to 20, such as dodecylsuccinic acid and octylsuccinic acid, a trimellitic acid, a pyromellitic acid, an anhydride of such an acid, and an alkyl (carbon number: from 1 to 3) ester of such an acid. A component containing one or more of these members is preferred.

Among these polyester resins, preferred is a full aromatic polyester resin (polyarylate resin) having a structural unit represented by the following formula (6):

(6)

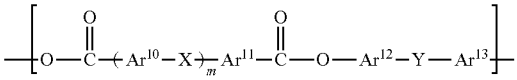

In formula (6), each of $Ar^{10}$ to $Ar^{13}$ independently represents an arylene group which may have a substituent, X represents a single bond, an oxygen atom, a sulfur atom or an alkylene group, m represents an integer of 0 to 2, and Y represents a single bond, an oxygen atom, a sulfur atom or an alkylene group.

In formula (6), each of $Ar^{10}$ to $Ar^{13}$ independently represents an arylene group which may have a substituent. The carbon number of the arylene group is usually 6 or more, preferably 7 or more, and the upper limit thereof is usually 20 or less, preferably 10 or less, more preferably 8 or less. If the carbon number is too large, the production cost rises and the electrical characteristics may also deteriorate.

Specific examples of $Ar^{10}$ to $Ar^{13}$ include a 1,2-phenylene group, a 1,3-phenylene group, a 1,4-phenylene group, a naphthylene group, an anthrylene group, and a phenanthrylene group. Among others, the arylene group is preferably a 1,4-phenylene group in view of electrical characteristics. One kind of an arylene group may be used alone, or two or more kinds of arylene group may be used in an arbitrary ratio in any combination.

Specific examples of the substituent on $Ar^{10}$ to $Ar^{13}$ include an alkyl group, an aryl group, a halogen group, and an alkoxy group. Among others, considering the mechanical characteristics as the binder resin for the photosensitive layer and the solubility in a coating solution for photosensitive layer formation, the alkyl group is preferably a methyl group, an ethyl group, a propyl group or an isopropyl group, the aryl group is preferably a phenyl group or a naphthyl group, the halogen group is preferably a fluorine atom, a chlorine atom, a bromine atom or an iodine atom, and the alkoxy group is preferably a methoxy group, an ethoxy group, a propoxy group or a butoxy group, Incidentally, in the case where the substituent is an alkyl group, the carbon number of the alkyl group is usually 1 or more and usually 10 or less, preferably 8 or less, more preferably 2 or less.

More specifically, each of $Ar^{12}$ and $Ar^{13}$ independently preferably has a number of substituents of 0 to 2 and in view of adhesive property, more preferably has a substituent. Above all, the number of substituents is preferably 1 in view of abrasion resistance, and the substituent is preferably an alkyl group, more preferably methyl group.

biphenyl-4,4'-dicarboxylic acid residue. Among these, a phthalic acid residue, an isophthalic acid residue, a terephthalic acid residue, a naphthalene-1,4-dicarboxylic acid residue, a naphthalene-2,6-dicarboxylic acid residue, a biphenyl-2,2'-dicarboxylic acid residue and a biphenyl-4,4'-dicarboxylic acid residue are preferred, and an isophthalic acid residue and a terephthalic acid residue are more preferred. Also, a plurality of these dicarboxylic acid residues may be used in combination. Specific preferred examples thereof include, in view of solubility and easy production, a polyarylate resin having a structural unit represented by the following formula (X) or (Y). In formulae (X) and (Y), the ratio between the isophthalic acid residue and the terephthalic acid residue is usually 50:50 but may be arbitrarily changed. In this case, the proportion of the terephthalic residue is preferably higher in view of electrical characteristics.

(X)

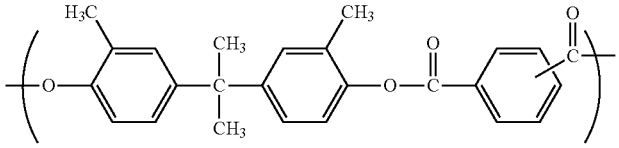

(Y)

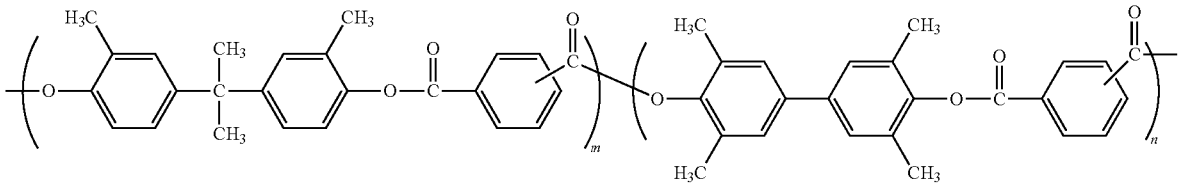

On the other hand, each of $Ar^{10}$ and $Ar^{11}$ independently preferably has a number of substituents of 0 to 2 and in view of abrasion resistance, more preferably no substituent.

In formula (6), Y is a single bond, an oxygen atom, a sulfur atom or an alkylene group. The alkylene group is preferably —$CH_2$—, —$CH(CH_3)$—, —$C(CH_3)_2$— or cyclohexylene, more preferably —$CH_2$—, —$CH(CH_3)$—, —$C(CH_3)_2$— or cyclohexylene, still more preferably —$CH_2$— or —$CH(CH_3)$—.

In formula (6), X is a single bond, an oxygen atom, a sulfur atom or an alkylene group. Above all, X is preferably an oxygen atom. At this time, m is preferably 0 or 1 and most preferably 1.

Specific preferred examples of the dicarboxylic acid residue when m is 1 include a diphenylether-2,2'-dicarboxylic acid residue, a diphenylether-2,3'-dicarboxylic acid residue, a diphenylether-2,4'-dicarboxylic acid residue, a diphenylether-3,3'-dicarboxylic acid residue, a diphenylether-3,4'-dicarboxylic acid residue, and a diphenylether-4,4'-dicarboxylic acid residue. Among these, in view of simple and easy production of the dicarboxylic acid component, a diphenylether-2,2'-dicarboxylic acid residue, a diphenylether-2,4'-dicarboxylic acid residue and a diphenylether-4,4'-dicarboxylic acid residue are preferred, and a diphenylether-4,4'-dicarboxylic acid residue is more preferred.

Specific examples of the dicarboxylic acid residue when m is 0 include a phthalic acid residue, an isophthalic acid residue, a terephthalic acid residue, a toluene-2,5-dicarboxylic acid residue, a p-xylene-2,5-dicarboxylic acid residue, a naphthalene-1,4-dicarboxylic acid residue, a naphthalene-2,3-dicarboxylic acid residue, a naphthalene-2,6-dicarboxylic acid residue, a biphenyl-2,2'-dicarboxylic acid residue, and a The binder resin for use in the present invention may have an arbitrary viscosity average molecular weight as long as the effects of the present invention are not seriously impaired, but the viscosity average molecular weight is preferably 10,000 or more, more preferably 20,000 or more, and the upper limit thereof is preferably 100,000 or less, more preferably 70,000 or less. If the viscosity average molecular weight is too small, the polyester resin may lack the mechanical strength, whereas if the viscosity average molecular weight is too large, the viscosity of the coating solution for photosensitive layer formation is excessively high and the productivity may be reduced. Incidentally, the viscosity average molecular weight can be measured, for example, using an Ubbelohde capillary viscometer or the like by the method described in Examples.

In addition to the above-described polyester resin, other binder resins may be mixed and used as long as the effects of the present invention are not impaired. Examples of the binder resin which may be mixed and used include a butadiene resin, a styrene resin, a vinyl acetate resin, a vinyl chloride resin, an acrylic acid ester resin, a methacrylic acid ester resin, a vinyl alcohol resin, a polymer or copolymer of a vinyl compound such as ethyl vinyl ether, a polyvinylbutyral resin, a polyvinylformal resin, a partially modified polyvinyl acetal, a polyamide resin, a polyurethane resin, a cellulose ester resin, a phenoxy resin, a silicon resin, a silicon-alkyd resin, and a poly-N-vinylcarbazole resin.

The charge transport layer is formed by applying the coating solution on the charge generation layer by a known method such as dip coating, spray coating, nozzle coating, bar coating, roll coating and blade coating, and then drying the coating.

As the solvent used in the production of the coating solution for the charge transport layer, a non-halogen solvent is used. It is preferred to use only a non-halogen solvent as the coating solvent, and an additive and the like may be contained therein. The non-halogen solvent indicates a solvent having no halogen atom in the molecular structure. Specific examples of the non-halogen solvent include ethers such as tetrahydrofuran, 1,4-dioxane, dioxolane and dimethoxyethane, esters such as formic acid, methyl and ethyl acetate, ketones such as acetone, methyl ethyl ketone, cyclopentanone, cyclohexanone and 4-methoxy-4-methyl-2-pentanone, aromatic hydrocarbons such as benzene, toluene and xylene, nitrogen-containing compounds such as n-butylamine, isopropanolamine, diethylamine, triethanolamine, ethylenediamine and triethylenediamine, and aprotic polar solvents such as acetonitrile, N-methylpyrrolidone, N,N-dimethylformamide and dimethyl sulfoxide. One of these solvents may be used alone, or two or more thereof may be used in combination.

The content of chlorobenzene in the charge transport layer is preferably 0.2 ng/cm$^2$ or less, and it is more preferred to contain no chlorobenzene. If chlorobenzene coming from other layers or used in the coating solvent or for the synthesis of CTM or the like remains in a large amount, this works out to a trap for a charge. Therefore, the content of chlorobenzene is preferably small.

In general, the polyester resin, among others, the polyarylate resin represented by formula (6), is higher in solubility for a halogen solvent such as dichloromethane and chlorobenzene than a non-halogen solvent and also gives a coating solution with good stability. However, the halogen-based solvent has a high molecular polarity and therefore, a slight amount of the solvent remains in the charge transport layer after drying. Particularly, the halogen-based solvent remaining near the charge generation layer/charge transport layer interface is thought to act as a trap for a charge (hole) and not only brings about a rise in the residual potential but also hardly allows a positive charge injected from the photoreceptor surface during transfer to escape into the conductive substrate, as a result, an image memory is disadvantageously caused to appear.

In view of a transfer memory, particularly, from the standpoint of preventing a white void at the photoreceptor edge due to repeated transfer load, it is preferred to synthesize a gallium phthalocyanine by using a halogen solvent and use a non-halogen solvent in the coating solution for forming a charge transport layer. The mechanism thereof is not clearly known but is presumed as follows. A transfer voltage (strong positive voltage) is repeatedly and directly received near the photoreceptor edge part due to a narrow-width paper sheet, and in this case, positive charges are partially injected into the inside of the photoreceptor from the photoreceptor surface and accumulated near the charge generation layer/charge transport layer interface or the like. When a halogen solvent is used in the coating solvent for a charge transport layer, the halogen solvent partially remains in the charge transport layer or charge generation layer and because of its electron withdrawing property, acts as a trap for a positive charge, promoting accumulation of positive charges, as a result, the residual potential rises to produce a white void on the image. On the other hand, the crystal of gallium phthalocyanine as a charge generating substance takes a halogen-based reaction solvent such as chloronaphthalene into the crystal lattice, thereby accelerating charge separation in the pigment, but does not work out to a trap for a charge and improves the transfer memory.

As for drying of the coating solution, after drying at room temperature, the coating solution is preferably heated/dried in static or blowing air at a temperature of usually from 30 to 200° C. for a time period in a range from 1 minute to 2 hours. The heating temperature may be constant, or heating may be performed at the drying while continuously or stepwise changing the temperature.

The film thickness of the charge transport layer is not particularly limited, but in view of long life and image stability as well as charging stability, the film thickness is usually 5 μm or more, preferably 10 μm or more, and usually 50 μm or less, preferably 45 μm or less, more preferably 30 μm or less, and from the standpoint of achieving high resolution, most preferably 25 μm or less.

<Other Functional Layers>

Also, in both the laminate-type photoreceptor and the single layer-type photoreceptor, the photosensitive layer formed by the above-described procedure may be caused to serve as the uppermost layer, that is, the surface layer, but another layer may be further provided thereon to serve as the surface layer. For example, a protective layer may be provided for the purposes of protecting the photosensitive layer against wear damage or preventing or keeping the photosensitive layer from deterioration due to a discharge product or the like generated, for example, from a charging device.

The electrical resistance of the protective layer is usually from $10^9$ to $10^{14}$ Ω·cm. If the electrical resistance exceeds this range, the residual potential rises to cause a lot of fogging on the image, whereas if the electrical resistance is less than the range above, blurring of the image and reduction in the resolution may be brought about. In addition, the protective layer must be configured not to substantially inhibit passing of irradiation light during imagewise exposure.

For the purpose of, for example, reducing the friction resistance or abrasion on the photoreceptor surface or increasing the transfer efficiency of toner from the photoreceptor to a transfer belt and paper, a fluorine-based resin, a silicon resin, a polyethylene resin or the like, a particle made of such a resin, or an inorganic compound particle may be incorporated into the surface layer. Alternatively, a layer containing such a resin or particle may be newly formed as the surface layer.

<Other Additives>

In both the laminate-type photoreceptor and the single layer-type photoreceptor, for the purpose of enhancing the deposition property, flexibility, coatability, contamination resistance, gas resistance, light resistance and the like, known additives such as antioxidant, plasticizer, ultraviolet absorber, electron-withdrawing compound, leveling agent and visible light-shielding agent may be incorporated into the photosensitive layer or each layer constituting the photosensitive layer.

<Image Forming Apparatus>

An embodiment of the image forming apparatus (image forming apparatus of the present invention) using the electrophotographic photoreceptor of the present invention is described below by referring to FIG. 1 which illustrates the configuration of main parts of the apparatus. However, the embodiment is not limited to the following description, and the present invention can be performed by arbitrarily making modifications therein without departing from the purport of the present invention.

As shown in FIG. 1, the image forming apparatus is configured to include an electrophotographic photoreceptor 1, a charging device 2, an exposure device 3, and a developing device 4, and furthermore, a transfer device 5, a cleaning device 6 and a fixing device 7 are provided, if desired.

The electrophotographic photoreceptor 1 is not particularly limited as long as it is the above-described electrophotographic photoreceptor of the present invention, but FIG. 1 shows, as an example thereof, a drum-shaped photoreceptor in which the photosensitive layer described above is formed on the surface of a cylindrical conductive support. Along the outer peripheral surface of the electrophotographic photoreceptor 1, the charging device 2, the exposure device 3, the developing device 4, the transfer device 5, and the cleaning device 6 are disposed.

The charging device 2 serves to charge the electrophotographic photoreceptor 1 and evenly charges the surface of the electrophotographic photoreceptor 1 to a given potential. Examples of the charging device which is often used include a corona charging device such as corotron and scorotron, and a direct charging device (contact-type charging device) in which a voltage-applied direct charging member is put into contact with the surface of the photoreceptor for charging. Examples of the direct charging device include a charging roller and a charging brush. Incidentally, in FIG. 1, a roller-type charging device (charging roller) is shown as one example of the charging device 2. As the direct charging method, both of charging involving atmospheric discharge and injection charging involving no atmospheric discharge can be used. The voltage applied at the charging may be a direct current voltage alone, or a direct current voltage may be used by superposing an alternate current voltage thereon.

The exposure device 3 is not particularly limited in its kind as long as it can expose the electrophotographic photoreceptor 1 and form an electrostatic latent image on the photosensitive surface of the electrophotographic photoreceptor 1. Specific examples thereof include a halogen lamp, a fluorescent lamp, a laser such as semiconductor laser and He—Ne laser, and LED. Also, the exposure may be performed by a photoreceptor internal exposure system. The light at the exposure is arbitrary, but the exposure may be performed, for example, to monochromatic light at a wavelength of 780 nm, monochromatic light slightly on the short wavelength side at a wavelength of 600 to 700 nm, or monochromatic light having a short wavelength at a wavelength of 380 to 500 nm.

The developing device 4 is not particularly limited in its kind, and an arbitrary device, for example, a dry development system such as cascade development, one-component insulating toner development, one-component conductive toner development and two-component magnetic brush development, or a wet development system, can be used. In FIG. 1, the developing device 4 includes a development tank 41, an agitator 42, a feed roller 43, a developing roller 44 and a regulating member 45 and is configured to store a toner T inside the development tank 41. If desired, a replenisher device (not shown) for replenishing the toner T may be attached to the developing device 4. The replenisher device is configured to enable replenishment of the toner T from a container such as bottle and cartridge.

The feed roller 43 is formed of an electrically conductive sponge or the like. The developing roller 44 is, for example, a roller made of a metal such as iron, stainless steel, aluminum and nickel, or a resin roller obtained by coating such a metal roller with a silicon resin, a urethane resin, a fluororesin or the like. If desired, the surface of the developing roller 44 may be subjected to smoothing or roughening processing.

The developing roller 44 is disposed between the electrophotographic photoreceptor 1 and the feed roller 43 and is abutted with each of the electrophotographic photoreceptor 1 and the feed roller 43. The feed roller 43 and the developing roller 44 are rotated each by a rotation driving mechanism (not shown). The feed roller 43 carries the stored toner T and feeds it to the developing roller 44. The developing roller 44 carries the toner T fed by the feed roller 43 and brings it into contact with the surface of the electrophotographic photoreceptor 1.

The regulating member 45 is formed by a resin blade made of a silicone resin, a urethane resin or the like, a metal blade made of stainless steel, aluminum, copper, brass, phosphor bronze or the like, or a blade produced by coating such a metal blade with a resin. The regulating member 45 is abutted with the developing roller 44 and is pushed toward the developing roller 44 by a spring or the like under a predetermined pressure (the blade linear pressure is generally from 5 to 500 g/cm). If desired, the regulating member 45 may be designed to have a function of charging the toner T by frictional charging with the toner T.

The agitator 42 is rotated by a rotation driving mechanism and while agitating the toner T, conveys the toner T toward the feed roller 43 side. A plurality of agitators 42 differing in the blade shape, the size or the like may be provided.

The toner T may be of its type and in addition to a powder toner, for example, a polymerized toner produced using a suspension polymerization method, an emulsification polymerization method or the like may be used. Above all, in the case of using a polymerized toner, a small-diameter toner having a particle diameter of approximately from 4 to 8 μm is preferred. As for the shape of the toner particle, various toner particles from a substantially spherical shape to a potato shape deviating from a sphere can be used. The polymerized toner is excellent in charging uniformity and transfer property and is suitably used for achieving a high image quality.

As for the transfer device 5, a device employing a direct electrostatic transfer method of performing transfer from the photoreceptor 1 onto recording paper without intervention of an intermediate transfer member is preferably used. Here, the transfer device 5 is composed of a transfer charger, a transfer roller, a transfer belt and the like, which are disposed to face the electrophotographic photoreceptor 1. The transfer device 5 transfers a toner image formed on the electrophotographic photoreceptor 1 onto recording paper (paper sheet, medium) P by applying a predetermined voltage (transfer voltage) having a polarity opposite that of the charged potential of the toner T. Incidentally, as compared with a system where an intermediate transfer member is provided, in the direct transfer system, the number of transfer steps is decreased by one step, so that reduction in the image quality due to transfer can be suppressed and the mechanism can be simple, which is advantageous in terms of cost. On the other hand, there are many restrictions in the kind of the transfer medium, and the above-described transfer memory (a white void at the edge due to fatigue by repeated transfer) may be disadvantageously produced depending on the size of the transfer medium, but this can be improved by using the photoreceptor above.

The cleaning device 6 is not particularly limited, and an arbitrary cleaning device such as brush cleaner, magnetic brush cleaner, electrostatic brush cleaner, magnetic roller cleaner and blade cleaner may be used. The cleaning device 6 scrapes away the residual toner adhering to the photoreceptor 1 by a cleaning member to collect the residual toner. In case where no or little toner remains on the photoreceptor surface, the cleaning device 6 may be omitted.

The fixing device 7 is composed of an upper fixing member (fixing roller) 71 and a lower fixing member (fixing roller) 72, and a heating device 73 is provided inside the fixing member 71 or 72. Incidentally, FIG. 1 shows an example where a heating device 73 is provided inside the upper fixing member 71. For each of the upper and lower fixing members 71 and 72, a known heat-fixing member, for example, a fixing roller obtained by coating an original metal pipe made of stainless steel, aluminum or the like with silicone rubber, a fixing roller further coated with Teflon resin, or a fixing sheet, can be used. Furthermore, the fixing members 71 and 72 may be configured to supply a release agent such as silicone oil for enhancing the releasability or may be configured to forcedly apply a pressure by a spring or the like.

The toner transferred onto the recording paper P is thermally heated up to a state of the toner melted in the course of passing between the upper fixing member 71 and the lower fixing member 72 each heated at a predetermined temperature and after passing therebetween, the toner is cooled and fixed on the recording paper P.

Here, the fixing device is also not particularly limited in its kind, and as well as the fixing device used above, a fixing device employing an arbitrary system such as heat roller fixing, flash fixing, oven fixing and pressure fixing can be provided.

In the thus-configured electrophotographic apparatus, image recording is performed as follows. That is, first, the surface (photosensitive surface) of the photoreceptor 1 is charged to a predetermined potential (for example, −600 V) by the charging device 2. At this time, the surface may be charged by a direct current voltage or may be charged by superposing an alternate current voltage on a direct current voltage.

Subsequently, the photosensitive surface of the charged photoreceptor 1 is exposed by the exposure device 3 according to the image to be recorded, thereby forming an electrostatic latent image on the photosensitive surface. The electrostatic latent image formed on the photosensitive surface of the photoreceptor 1 is then developed by the developing device 4.

In the developing device 4, the toner T fed by the feed roller 43 is regulated to a thin layer by the regulating member (developing blade) 45, frictionally charged to a predetermined polarity (here, the same polarity as the charging potential of the photoreceptor 1, that is, negative polarity), conveyed on the developing roller 44, and brought into contact with the surface of the photoreceptor 1.

When the electrically charged toner T carried on the developing roller 44 comes into contact with the photoreceptor 1 surface, a toner image corresponding to the electrostatic latent image is formed on the photosensitive surface of the photoreceptor 1. This toner image is then transferred onto the recording paper P by the transfer device 5. Thereafter, the toner not transferred but remaining on the photosensitive surface of the photoreceptor 1 is removed by the cleaning device 6.

After transferring the toner image onto the recording paper P, the paper is passed through the fixing device 7 to heat-fix the toner image on the recording paper P, whereby a final image is obtained.

Incidentally, in addition to the above-described configuration, the image forming apparatus may have a configuration where, for example, a charge erasing step can be performed. The charge erasing step is a step of exposing the electrophotographic photoreceptor and thereby erasing the charge of the electrophotographic photoreceptor. As for the charge erasing device, a fluorescent lamp, LED or the like is used. Also, the light used in the charge erasing step is, in many cases, light having an intensity of, in terms of the exposure energy, 3 times or more that of the exposure light.

The image forming apparatus may also have a modified configuration, for example, may be configured to allow for steps such as pre-exposure step and auxiliary charging step, may be configured to perform offset printing, or may be configured in a full-color tandem system using a plurality of kinds of toners.

Here, the photoreceptor 1 may be configured as an integrated cartridge (hereinafter, sometimes referred to as "electrophotographic photoreceptor cartridge") by combining one member or two or more members out of the charging device 2, the exposure device 3, the developing device 4, the transfer device 5, the cleaning device 6 and the fixing device 7, and the electrophotographic photoreceptor cartridge may be configured to be removable from the main body of the electrophotographic apparatus such as copying machine and laser beam printer. In this case, for example, when the electrophotographic photoreceptor 1 or other members are deteriorated, the electrophotographic photoreceptor cartridge is removed from the main body of the image forming apparatus, and another new electrophotographic photoreceptor cartridge is attached to the main body of the image forming device, whereby the maintenance/management of the image forming device is facilitated.

EXAMPLES

The embodiment of the present invention is described in greater detail below by referring to Examples. However, the following Examples are given for explaining the present invention in detail, and the present invention is not limited to these Examples but can be performed by arbitrarily making modifications therein without departing from the purport of the present invention. In the following Examples and Comparative Examples, unless otherwise indicated, the "parts" indicates "parts by weight" or "parts by mass".

Example 1

<Production of Coating Solution for Forming Undercoat Layer>

Rutile titanium oxide having an average primary particle diameter of 40 nm ("TTO55N", produced by Ishihara Sangyo Kaisha, Ltd.) and methyldimethoxysilane ("TSL8117", produced by Toshiba Silicones) in an amount of 3 mass % based on the titanium oxide were mixed in a Henschel mixer, and the obtained surface-treated titanium oxide was dispersed in a mixed solvent of methanol/1-propanol at a weight ratio of 7/3 by a ball mill to make a dispersion slurry of surface-treated titanium oxide. This dispersion slurry, a mixed solvent of methanol/1-propanol/toluene, and a pellet of a copolymerized polyamide composed of c-caprolactam [the compound represented by the following formula (A)]/bis(4-amino-3-methylcyclohexyl)methane [the compound represented by the following formula (B)]/hexamethylenediamine [the compound represented by the following formula (C)]/decamethylenedicarboxylic acid [the compound represented by the following formula (D)]/octadecamethylenedicarboxylic acid [the compound represented by the following formula (E)] in a compositional molar ratio of 60%/15%/5%/15%/5% were stirred and mixed under heating to dissolve the polyamide pellet, and the obtained solution was subjected to an ultrasonic dispersion treatment to produce a coating solution for undercoat layer formation containing surface-treated titanium oxide/copolymerized polyamide in a weight ratio of 3/1 and having a solid content concentration of 18.0%, in which the weight ratio of methanol/1-propanol/toluene was 7/1/2.

A

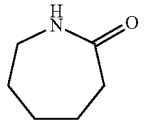

B

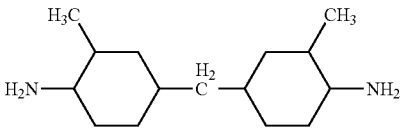

C

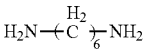

D

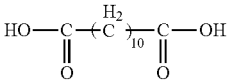

E

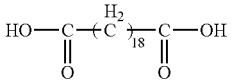

<Production of Coating Solution for Charge Generation Layer Formation>

Figure 2:
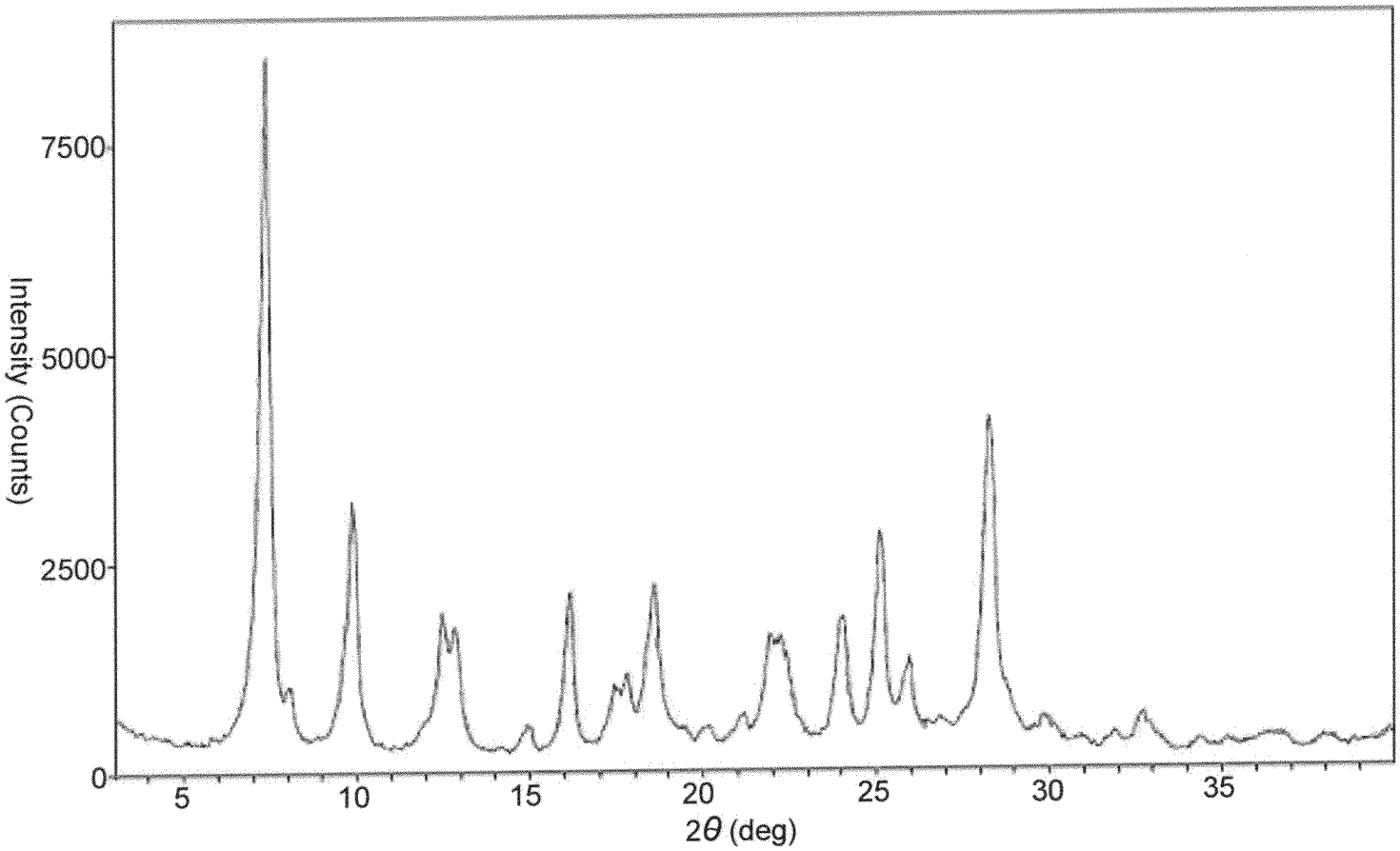
FIG. 2 is a powder X-ray diffraction chart of V-type hydroxygallium phthalocyanine used in Example 1.

20 Parts of V-type hydroxygalliuim phthalocyanine as a charge generating substance, exhibiting a diffraction peak pattern shown in FIG. 2 in the X-ray diffraction by CuKα ray, which is produced using a halogen solvent (1-chloronaphthalene) as the reaction solvent and described in Example 1 of Patent Document 2, and 280 parts of 1,2-dimethoxyethane were mixed, and the mixture was ground in a sand grinding mill for 1 hour to perform a pulverization/dispersion treatment. This pulverization-treated solution was mixed with a binder solution obtained by dissolving 10 parts of polyvinylbutyral ("Denka Butyral" #6000C, trade name, produced by Denki Kagaku Kogyo K.K.) in a mixed solution of 255 parts of 1,2-dimethoxyethane and 85 parts of 4-methoxy-4-methyl-2-pentanone and with 230 parts of 1,2-dimethoxyethane to prepare a coating solution for charge generation layer formation.

<Production of Coating Solution for Charge Transport Layer Formation>

100 Parts of Polyarylate Resin (B-1) having a repeating structure shown below (viscosity average molecular weight: 35,000, terephthalic acid:isophthalic acid=50:50); 40 parts of Compound (1)-2 and 40 parts of Compound (2)-1, as charge transport substances; and 0.05 parts of silicone oil (KF96, trade name, produced by Shin-Etsu Silicone), were dissolved in 520 parts of a 80/20 (by weight) mixed solvent of tetrahydrofuran (hereinafter, sometimes simply referred to as THF)/toluene (hereinafter, sometimes simply referred to as TL) to prepare a coating solution for charge transport layer formation.

(B-1)

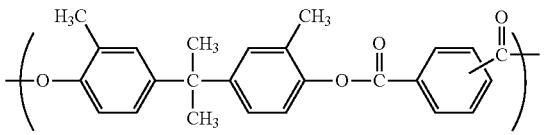

<Production of Photoreceptor>

On a polyethylene terephthalate sheet having deposited on the surface thereof aluminum, the coating solution for undercoat layer formation obtained above was coated by a wire bar to have a film thickness of about 1.3 μm after drying and dried at room temperature to provide a undercoat layer.

On this undercoat layer, the coating solution for charge generation layer formation obtained above was coated by a wire bar to have a film thickness of about 0.3 μm after drying and dried at room temperature to provide a charge generation layer.

On this charge generation layer, the coating solution for charge transport layer formation obtained above was coated by an applicator to have a film thickness of about 25 μm after drying and dried at 125° C. for 20 minutes to produce a photoreceptor.

<Initial Electrical Characteristic Test>

Using an apparatus for evaluating electrophotographic characteristics manufactured in accordance with the measurement standards by the Society of Electrophotography of Japan (described in *Zoku Denshi Shashin Gijutsu no Kiso to Oyo* (*Basic and Application of Electrophotographic Technology, Part II*), compiled by the Society of Electrophotography of Japan, Corona Publishing Co., Ltd., pp. 404-405), the sheet-like photoreceptor obtained above was wound around an aluminum-made cylinder having a diameter of 80 mm and after attaching a grounding wire, charged to give an initial surface potential of about −750 V (the initial surface potential here is referred to as $V_0$). Also, the retention (%) (referred to as DDR) of the initial surface potential after holding in a dark place for 5 seconds was measured. After charging, the surface potential (bright potential; referred to as VL) when exposed to 780-nm monochromatic light at 0.8 μJ/cm$^2$ into which light of a halogen lamp is converted through an interference filter was determined. The time from exposure to potential measurement was set to 60 ms. After exposure to the monochromatic light, static electricity was removed by red LED light. The measurement was performed in an environment of 25° C. and 50% RH. A large absolute value of VL indicates a large amount of charge remaining and bad electrical characteristics.

<Transfer Memory Test>

After performing the initial electrical characteristic test, the destaticized part was removed and instead, a corotron to which +6.5 kV is applied was provided so as to simulate transfer load. In this state, the cycle of charging-exposure-transfer load was repeated 4,000 times and thereafter, VL, DDR and $V_0$ were again measured to determine the differences ΔVL, ΔDDR and $\Delta V_0$ from the initial values. The measurement was performed in an environment of 25° C. and 50% RH. The results are shown in Table 1. Smaller absolute values of ΔVL, ΔDDR and $\Delta V_0$ indicate better performance in terms of transfer memory, and the ΔVL particularly contributes to the transfer memory.

Example 2

A photoreceptor was produced and evaluated in the same manner as in Example 1 except that in Example 1, the charge transport substance (2)-1 was not used and the amount of (1)-2 was changed to 80 parts. The results are shown in Table-1.

Example 3

A photoreceptor was produced and evaluated in the same manner as in Example 1 except that in Example 1, the binder resin B-1 was changed to B-2 shown below (viscosity average molecular weight: 40,000). The results are shown in Table-1.

(B-2)

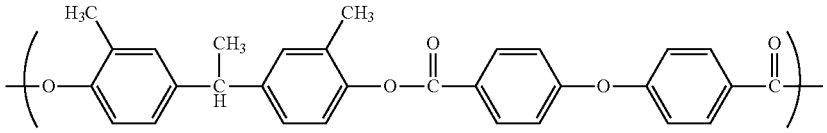

Example 4

A photoreceptor was produced and evaluated in the same manner as in Example 1 except that in Example 1, the coating solution for charge transport layer formation was changed to THF/anisole (simply referred to as ANS) in a weight ratio of 90/10. The results are shown in Table-1.

Example 5

A photoreceptor was produced and evaluated in the same manner as in Example 1 except that in Example 1, the coating solution for charge transport layer formation was changed to dioxolane (simply referred to as DOL) alone. The results are shown in Table-1.

Comparative Example 1

A photoreceptor was produced and evaluated in the same manner as in Example 1 except that in Example 1, the solvent in the coating solution for charge transport layer was changed from THF/TL (80/20) to dichloromethane (hereinafter, sometimes simply referred to as DCM) alone. The results are shown in Table-1.

Comparative Example 2

A photoreceptor was produced and evaluated in the same manner as in Example 2 except that in Example 2, the solvent in the coating solution for charge transport layer was changed from THF/TL (80/20) to dichloromethane (hereinafter, sometimes simply referred to as DCM) alone. The results are shown in Table-1.

Comparative Example 3

A photoreceptor was produced and evaluated in the same manner as in Example 3 except that in Example 3, the solvent in the coating solution for charge transport layer was changed from THF/TL (80/20) to DCM alone. The results are shown in Table-1.

Comparative Example 4

A photoreceptor was produced and evaluated in the same manner as in Example 1 except that in Example 1, the charge generating substance was changed to V-type hydroxygallium phthalocyanine (G-2) produced using a non-halogen solvent (quinoline) as the reaction solvent, which is described in Example 1 of Patent Document 2. The results are shown in Table-1.

Comparative Example 5

A photoreceptor was produced and evaluated in the same manner as in Example 1 except that in Example 1, the charge generating substance was changed to Y-type (another name: D-type) oxytitanium phthalocyanine (G-3) produced using a halogen solvent (1-chloronaphthalene) as the reaction solvent, which exhibits a strong diffraction peak at a Bragg angle (2θ±0.2) of 27.3° in the X-ray diffraction by CuKα ray. The results are shown in Table-1.

Comparative Example 6

A photoreceptor was produced and evaluated in the same manner as in Example 3 except that in Example 3, the charge generating substance was changed to Y-type (another name: D-type) oxytitanium phthalocyanine (G-3) produced using a halogen solvent (1-chloronaphthalene) as the reaction solvent, which exhibits a strong diffraction peak at a Bragg angle (2θ±0.2) of 27.3° in the X-ray diffraction by CuKα ray. The results are shown in Table-1.

Reference Example 1

A photoreceptor was produced and evaluated in the same manner as in Example 1 except that in Example 1, the binder resin was changed to B-3 shown below (viscosity average molecular weight: 40,000). The results are shown in Table-1.

(B-3)

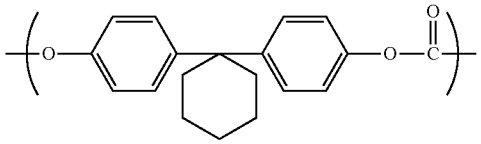

Reference Example 2

A photoreceptor was produced and evaluated in the same manner as in Comparative Example 4 except that in Reference Example 1, the solvent in the coating solution for charge transport layer was changed from THF/TL (80/20) to DCM alone. The results are shown in Table-1.

TABLE 1

| | Charge Generating Substance | Charge Transport Substance-1 | Charge Transport Substance-2 | Binder Resin | Coating Solvent for Charge Transport Layer | VL (−V) at the initial | VL (−V) after 4K | ΔVL (−V) |
|---|---|---|---|---|---|---|---|---|
| Example 1 | G-1 | (1)-2 | (2)-1 | B-1 | THF/TL | 67 | 113 | 46 |
| Example 2 | G-1 | (1)-2 | — | B-1 | THF/TL | 50 | 119 | 69 |

TABLE 1-continued

| | | | | | | | | |
|---|---|---|---|---|---|---|---|---|
| Example 3 | G-1 | (1)-2 | (2)-1 | B-2 | THF/TL | 39 | 62 | 23 |
| Example 4 | G-1 | (1)-2 | (2)-1 | B-1 | THF/ANS | 70 | 112 | 42 |
| Example 5 | G-1 | (1)-2 | (2)-1 | B-1 | DOL | 72 | 119 | 47 |
| Comparative Example 1 | G-1 | (1)-2 | (2)-1 | B-1 | DCM | 88 | 155 | 67 |
| Comparative Example 2 | G-1 | (1)-2 | — | B-1 | DCM | 58 | 134 | 76 |
| Comparative Example 3 | G-1 | (1)-2 | (2)-1 | B-2 | DCM | 36 | 59 | 23 |
| Comparative Example 4 | G-2 | (1)-2 | (2)-1 | B-1 | THF/TL | 74 | 148 | 74 |
| Comparative Example 5 | G-3 | (1)-2 | (2)-1 | B-1 | THF/TL | 82 | 135 | 53 |
| Comparative Example 6 | G-3 | (1)-2 | (2)-1 | B-2 | THF/TL | 77 | 127 | 50 |
| Reference Example 1 | G-1 | (1)-2 | (2)-1 | B-3 | THF/TL | 24 | 23 | −1 |
| Reference Example 2 | G-1 | (1)-2 | (2)-1 | B-3 | DCM | 186 | 184 | −2 |

| | DDR (%) at the initial | DDR (%) after 4K | ΔDDR (%) | $V_0$ (−V) at the initial | $V_0$ (−V) after 4K | $\Delta V_0$ (−V) | Image Evaluation |
|---|---|---|---|---|---|---|---|
| Example 1 | 88.2 | 84.9 | −3.3 | 751 | 622 | −129 | Good (Example 6) |
| Example 2 | 83.6 | 80.6 | −3.0 | 764 | 653 | −111 | |
| Example 3 | 87.5 | 82.3 | −5.2 | 744 | 655 | −89 | |
| Example 4 | 89.4 | 83.7 | −5.7 | 748 | 635 | −113 | |
| Example 5 | 87.8 | 82.8 | −5.0 | 761 | 654 | −107 | Good (Example 7) |
| Comparative Example 1 | 83.4 | 82.7 | −0.7 | 766 | 664 | −102 | Density at edge was reduced (Comparative Example 8) |
| Comparative Example 2 | 84.4 | 82.8 | −1.6 | 731 | 614 | −117 | |
| Comparative Example 3 | 79.9 | 75.4 | −4.5 | 747 | 629 | −118 | |
| Comparative Example 4 | 86.5 | 81.3 | −5.2 | 733 | 571 | −162 | Density at edge was reduced (Comparative Example 9) |
| Comparative Example 5 | 95.1 | 93.5 | −1.6 | 741 | 614 | −127 | Density was reduced at low humidity, positive ghost (Comparative Example 10) |
| Comparative Example 6 | 94.3 | 92.3 | −2.0 | 735 | 617 | −118 | Density was reduced at low humidity, positive ghost (Comparative Example 11) |
| Reference Example 1 | 87.4 | 81.5 | −5.9 | 749 | 649 | −100 | Toner attached (Reference Example 4) |
| Reference Example 2 | 73.6 | 70.4 | −3.2 | 807 | 710 | −97 | |

As seen from Table-1, when a halogen-containing solvent, that is, DCM (dichloromethane) is used as the coating solvent for charge transport layer, in Comparative Examples 1 and 2, the initial value of VL is large and the rise due to transfer load is also large. In Comparative Example 3, the rise of VL is seemingly suppressed but in practice, the value of DDR reveals great reduction of chargeability and also great value of $\Delta V_0$. In Comparative Examples 6, ΔVL is large and reduction of density is also observed. As in the Reference Examples 1 and 2, when using the polyester that is outside the scope of the present invention, there is no change in a degree of rise due to the transfer load.

Example 6

<Production of Photoreceptor Drum>

On an aluminum-made cylinder having a rough cut finished and cleanly washed surface and having an outer diameter of 30 mm, a length of 376 mm and a wall thickness of 0.75 mm, the coating solution for undercoat layer formation, the coating solution for charge generation layer formation, and the coating solution for charge transport layer formation each used for the production of the photoreceptor of Example 1 were successively coated by a dip coating method and dried to form a undercoat layer, a charge generation layer and a charge transport layer having a dry thickness of 1.3 μm, 0.4 (m, and 25 (m, respectively, whereby a photoreceptor drum was produced. Incidentally, drying of the charge transport layer was performed at 125 (C for 20 minutes.

<Image Test>

The image test was performed in a dry development electrophotographic system by using a tandem full color printer, MICROLINE 9800, manufactured by Oki Data Corporation of a direct transfer system from photoreceptor to paper by means of a charging roller and a conveying belt, which is set to a printing speed of 243 minis and employs nonmagnetic one-component development. The test was performed in an environment of 25 (C and 50% RH.

The produced photoreceptor drum (four drums equivalent in quality) was loaded in a process cartridge for each of cyan, magenta, yellow and black colors, and printing on 1,000 sheets was performed by longitudinally feeding A4 paper. Thereafter, an entire halftone image was printed by cross-feeding A4 paper, as a result, an image defect such as density unevenness at edge was not observed. Also, entire halftone printing was performed by changing the test environment to 25 (C and 10% RH, but density reduction was not observed.

<Measurement of (-Chloronaphthalene>

After removing the charge transport layer of the photoreceptor drum produced in Example 6, the charge generation layer was dissolved in an organic solvent corresponding to about 100 $cm^2$ and then isolated by reprecipitation, and (-chloronaphthalene (another name: 1-chloronaphthalene) contained in the layer was measured by the GC/MS method. The quantitative determination was performed by producing a calibration curve for an (-chloronaphthalene preparation with a known concentration and calculating the amount from the peak area. Also, the standard preparation was added before dissolving and reprecipitating the sample and after confirming where the recovery ratio stands, the theoretical value of in-liquid concentration and the detection amount per area were calculated from the recovery ratio. As a result, 0.6 $ng/cm^2$ of (-chloronaphthalene was detected.

Example 7

A photoreceptor drum was produced and evaluated in the same manner as in Example 6 except that in Example 6, the coating solution for charge transport layer formation was changed to dioxolane (simply referred to as DOL) alone. After printing on 1,000 sheets by longitudinally feeding A4 paper, an entire halftone image was printed by cross-feeding A4-paper, as a result, an image defect such as density unevenness at edge was not observed. Also, entire halftone printing was performed by changing the test environment to 25 (C and 10% RH, but density reduction was not observed.

Comparative Example 7

A photoreceptor drum was produced in the same manner as in Example 6 except that the coating solution used in the production of the photoreceptor of Comparative Example 1 was used in place of the coating solution used in the production of the photoreceptor of Example 6, and an image test was performed. After printing on 1,000 sheets by longitudinally feeding A4 paper, an entire halftone image was printed by cross-feeding A4-paper, as a result, density reduction was observed near the edge where A4 paper did not pass.

Comparative Example 8

A photoreceptor drum was produced in the same manner as in Example 6 except that the coating solution used in the production of the photoreceptor of Comparative Example 4 was used in place of the coating solution used in the production of the photoreceptor of Example 6, and an image test was performed. After printing on 1,000 sheets by longitudinally feeding A4 paper, an entire halftone image was printed by cross-feeding A4-paper, as a result, density reduction was observed near the edge where A4 paper did not pass.

Reference Example 3

A photoreceptor drum was produced in the same manner as in Example 6 except that the coating solution used in the production of the photoreceptor of Reference Example 1 was used in place of the coating solution used in the production of the photoreceptor of Example 6, and an image test was performed. After printing on 1,000 sheets by longitudinally feeding A4 paper, an entire halftone image was printed by cross-feeding A4-paper, as a result, density reduction near the edge was not observed but the toner component was attached throughout the photoreceptor surface and many point-like defects were observed in the image.

Comparative Example 9

A photoreceptor drum was produced in the same manner as in Example 6 except that the coating solution used in the production of the photoreceptor of Comparative Example 5 was used in place of the coating solution used in the production of the photoreceptor of Example 6, and an image test was performed. After printing on 1,000 sheets by longitudinally feeding A4 paper, an entire halftone image was printed by cross-feeding A4-paper, as a result, density reduction near the edge was not observed but a positive ghost was observed. Subsequently, entire halftone printing was performed by changing the test environment to 25 (C and 10% RH, as a result, significant density reduction was observed on the entire surface.

Comparative Example 10

A photoreceptor drum was produced in the same manner as in Example 6 except that the coating solution used in the production of the photoreceptor of Comparative Example 6 was used in place of the coating solution used in the production of the photoreceptor of Example 6, and an image test was performed. After printing on 1,000 sheets by longitudinally feeding A4 paper, an entire halftone image was printed by cross-feeding A4-paper, as a result, density reduction near the edge was not observed but a positive ghost was observed. Subsequently, entire halftone printing was performed by changing the test environment to 25 (C and 10% RH, as a result, significant density reduction was observed on the entire surface.

This application is based on Japanese patent application JP 2012-135040, filed on Jun. 14, 2012, the entire content of which is hereby incorporated by reference, the same as if set forth at length.

What is claimed is:

1. An electrophotographic photoreceptor comprising: a conductive support; and at least a charge generation layer and a charge transport layer on the conductive support, wherein said charge generation layer contains α-chloronaphthalene and a hydroxygallium phthalocyanine, said charge transport layer contains a polyester resin having a structural unit represented by the following formula (6) in an amount effective to function as a binder resin, and said charge transport layer is formed using a non-halogen solvent:

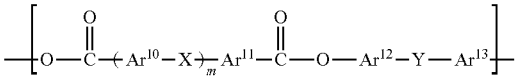

(6)

wherein each of $Ar^{10}$ and $Ar^{13}$ independently represents an arylene group which may have a substituent, $Ar^{11}$ represents a phenylene group, $Ar^{12}$ represents a phenylene group having a methyl group, X represents a single bond, an oxygen atom, a sulfur atom or an alkylene group, m represents 0, and Y represents an alkylene group, wherein the content of said α-chloronaphthalene is from 0.2 to 1.0 $ng/cm^2$ and the content of chlorobenzene in the charge transport layer is 0.2 $ng/cm^2$ or less, wherein said charge transport layer contains a charge transport substance represented by the following formula (1)-2 and said charge transport layer is formed using only a non-halogen solvent:

(1)-2

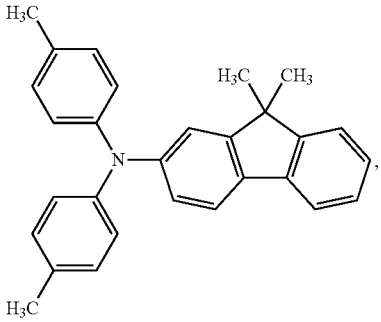

wherein said charge transport layer contains a charge transport substance represented by the following formula (2)-1:

(2)-1

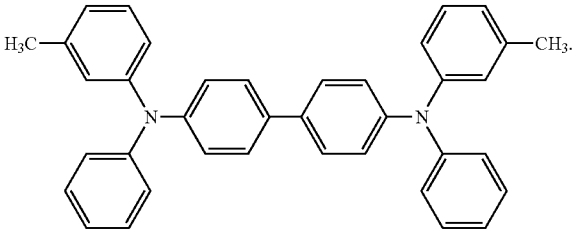

2. The electrophotographic photoreceptor of claim 1, wherein the mixing ratio between the charge transport substance represented by formula (1)-2 and the charge transport substance represented by formula (2)-1 is from 20:80 to 95:5.

3. The electrophotographic photoreceptor of claim 1, wherein the mixing ratio between the charge transport substance represented by formula (1)-2 and the charge transport substance represented by formula (2)-1 is from 30:70 to 90:10.

4. The electrophotographic photoreceptor of claim 1, wherein the mixing ratio between the charge transport substance represented by formula (11)-2 and the charge transport substance represented by formula (2)-1 is from 40:60 to 90:10.

5. The electrophotographic photoreceptor of claim 1, wherein the charge generation layer contains a hydroxygallium phthalocyanine in an amount from 30 parts by mass to 500 parts by mass, per 100 parts by mass of the binder resin.

6. An image forming apparatus, comprising:

the electrophotographic photoreceptor of claim 1;

a printing member; and toner, wherein the toner developed on the electrophotographic photoreceptor is directly transferred onto the printing member without intervention of an intermediate transfer member.

* * * * *